US005129343A

United States Patent [19]

Giles

[11] Patent Number: 5,129,343

[45] Date of Patent: Jul. 14, 1992

[54] MONOHULL FAST SHIP

[76] Inventor: David L. Giles, 4244 Hunt Club Cir., Apt. 1534, Fairfax, Va. 22033

[21] Appl. No.: 678,646

[22] Filed: Apr. 1, 1991

Related U.S. Application Data

[63] Continuation-in-part of Ser. No. 525,072, May 18, 1990, Pat. No. 5,080,032.

[30] Foreign Application Priority Data

Oct. 11, 1989 [GB] United Kingdom ..... 8922936

[51] Int. Cl.[5] ..... B63B 1/16

[52] U.S. Cl. ..... 114/56; 114/121; 440/40

[58] Field of Search ..... 114/56, 65 R, 125, 72, 114/121; 440/47, 40, 42, 43

[56] References Cited

U.S. PATENT DOCUMENTS

| | | | |
|---|---|---|---|
| 1,505,113 | 8/1924 | Warnock | 114/56 |
| 2,185,430 | 1/1940 | Burgess | 114/56 |
| 2,185,431 | 1/1940 | Burgess | 114/56 |
| 2,342,707 | 2/1944 | Troyer | 114/56 |
| 2,570,595 | 9/1947 | Romero | 114/56 |
| 2,974,624 | 3/1961 | Lewis | 114/56 |
| 3,304,906 | 2/1967 | Nace | 440/4 |
| 3,342,032 | 9/1967 | Cox et al. | 60/221 |
| 3,776,168 | 12/1973 | Weeks | 114/56 |
| 3,911,846 | 10/1975 | England | 114/66.5 R |
| 3,995,575 | 12/1976 | Jones, Jr. | 114/66.5 H |
| 4,004,542 | 1/1977 | Holmes | 115/14 |
| 4,079,688 | 3/1978 | Diry | 114/56 |
| 4,276,035 | 6/1981 | Kobayashi | 440/47 |
| 4,523,536 | 6/1985 | Smoot | 114/67 R |
| 4,611,999 | 9/1986 | Haynes | 440/47 |
| 4,631,032 | 12/1986 | Nishida | 440/47 |
| 4,713,027 | 12/1987 | Fowler | 440/47 |
| 4,718,870 | 1/1988 | Watts | 440/47 |
| 4,775,341 | 10/1988 | Tyler et al. | 440/38 |
| 4,843,993 | 7/1989 | Martin | 114/125 |

FOREIGN PATENT DOCUMENTS

| | | |
|---|---|---|
| 409181 | 4/1934 | United Kingdom . |
| 739771 | 11/1955 | United Kingdom . |

OTHER PUBLICATIONS

Hill-Norton Committee Report, Hull Forms For Warships, United Kingdom, 1986, pp. 1-36.

Lloyd's Register of Shipping Report, *Warship Hull Design Inquiry*, London, 1988, Chapters 1-8 and Appendices.

*Primary Examiner*—Sherman D. Basinger

*Attorney, Agent, or Firm*—Antonelli, Terry Stout & Kraus

[57] ABSTRACT

A vessel (10) has a semi-displacement or semi-planing round bilge hull (11) characterized by low length-to-beam ratio (between about 5.0 to 7.5) and utilizing hydrodynamic lift. The bottom (15) of the hull (11) rises toward the stern (17) and flattens out at the transom (30). Four waterjet propulsion units (26, 27, 28, 29) are mounted at the transom (30 1) with inlets (31) arranged on the hull bottom (15) just forward of the transom (30) in a high pressure area. Water under high pressure is directed to the pumps (32) from the inlets (31). Eight marine gas turbines arranged in pairs (36/37, 38/39, 40/41, 42/43) power the waterjet propulsion units (26, 27, 28, 29) through combined gearboxes (44, 45, 46, 47) and cardan shafts (48, 49, 50, 51).

27 Claims, 13 Drawing Sheets

○ AT 45 KNOTS
● AT 30 KNOTS
○MFS
DDG-51
CGN 38
MFS
KIROV
CVN 68
CG-47
SL-7
SPECIFIC POWER (HP/D×V)
0.5
0.4
0.3
0.2
0.1
0
400
500
600
700
800
900
1000
1100
LENGTH - FEET

MONOHULL FAST SHIP

CROSS REFERENCE TO RELATED APPLICATION

This application is a Continuation-In-Part of U.S. patent application Ser. No. 525,072, filed May 18, 1990, now U.S. Pat. No. 5,080,032. The aforementioned application is incorporated herein by reference in its entirety.

TECHNICAL FIELD

The present invention relates to a fast ship whose hull design in combination with a waterjet propulsion system permits, for ships of about 25,000 to 30,000 tons displacement with a cargo carrying capacity of up to 10,000 tons, transoceanic transit speeds of up to 37 to 50 knots in high or adverse sea states, speeds heretofore not achievable in ships of such size without impairment of stability or cargo capacity or constructed at such prohibitive cost as to render them commercially or militarily unviable.

BACKGROUND ART

It has long been the goal of naval architects to design and construct vessels with adequate internal capacities and accommodations, structural strength, stability and seaworthiness when the vessel is afloat and sufficiently small resistance to economize propelling power at high speeds as evidenced by U.S. Pat. Nos. 2,185,430, 2,342,707 and 4,079,688.

Traditional surface ship monohull designs have usually been developed from established design principles and assumptions which concern the interrelationships of speed, stability and seakeeping. Such sacrifices have to be made to achieve significantly higher performance than hitherto that current practical displacement monohull surface ship speed improvements are essentially stalled.

For example, a major limitation of present day displacement hulls is that, for a given size (in terms of displacement or volume), their seaworthiness and stability are reduced as they are "stretched" to a greater length in order to increase maximum practical speed.

Traditional hull designs inherently limit the speed with which large cargo ships can traverse the ocean because of the drag rise which occurs at the "threshold speed". This is a speed (in knots) which is about equal to the square root of the ship's length (in feet). For example, a mid-size cargo ship at about 600 feet length has an economical operating speed of about 20 knots or some 4 knots below its design threshold speed. In order to achieve higher operating speeds with commercial loads, it is necessary to increase ship length and size (or volume) in proportion, or to increase length while reducing width or beam, to maintain the same size and volume, but at the expense of stability. Naval architects have long considered the problem of achieving significantly higher ship speeds, without increasing length or decreasing beam, as the equivalent of "breaking the sound barrier" in aeronautical technology.

In the nineteenth century, Dr. Froude first accurately measured and defined the phenomenon by which increased length is required for higher ship speeds because of the prohibitive drag rise which occurs at a threshold speed corresponding to a length Froude Number of 0.3. The length Froude Number is defined by the relationship 0.298 times the speed length ratio $\sqrt{L}^{V}$, where V is the speed of the ship in knots and L is the waterline length of the ship in feet. Thus a Froude number of 0.298 equates to a speed length ratio of 1.0. According to Froude's teaching, to go faster for the same volume the ship must be made longer, thus pushing the onset of this drag rise up to a higher speed. As length is increased for the same volume, however, the ship becomes narrower, stability is sacrificed, and it is subject to greater stress, resulting in a structure which must be proportionately lighter and stronger (and therefore more costly) if structural weight is not to become excessive. In addition, while for a given displacement the longer ship will be able to achieve higher speeds, the natural longitudinal vibration frequency is lowered and seakeeping degraded in high or adverse sea states as compared to a shorter, more compact ship.

An alternative means to achieve high speed ships is the planing hull. To date, this popular concept has been limited to a very short hull form, i.e. typically no more than 100 feet and under 100 tons. Boats of only 50 foot length are able to achieve speeds of over 60 knots (a Froude Number of 2.53 or a speed length ratio of 8.5). This is possible because the power available simply pushes the boat up onto the surface of the water where it aquaplanes across the waves, thus eliminating the huge drag rise which prohibits a pure displacement boat of normal proportions from going more than about 9 knots on the same length of hull. However, at intermediate speeds of say 5 to 25 knots, before this 50 foot boat "gets onto the plane", a disproportionately large amount of power is required. If the 50 foot planing boat is scaled to the length of a frigate of 300 feet, these speeds scale to the precise range of 12 to 60 knots. Thus scaled, the power required for a 300 foot planing frigate to achieve its minimum practical speed (60 knots) would be about half a million horsepower; but currently such horsepower cannot be installed, let alone delivered in a ship of such small size and low displacement. Furthermore, the ensuing ride on this 300 foot ship would cause material fatigue as its large flat hull surfaces would be slammed at continuously high speed into the ocean waves inasmuch as it would be too slow to plane or "fly" across the waves as a much smaller planing craft would do.

Craft utilizing planing hulls have also been produced with waterjet propulsion. Due to limitations of size, tonnage and required horsepower, however, the use of a waterjet propelled planing hull vessel for craft over 100 feet waterline length or 100 tons displacement has not been seriously considered.

The planing hull incorporates, typically, a combination of very high power, flat or concave "vee'd" bottom sections, often incorporating warped surfaces, with an angular section or "chine" at the conjunction of the sides and bottom portion, necessary for clean flow separation giving enhanced aquaplaning capabilities and imparting higher stability at very high speeds. It also characteristically features an extremely lightweight structure of wood, aluminum or fiberglass.

U.S. Pat. No. 2,185,430 (W. Starling Burgess) describes one of many interpretations of this type of hull, of which the inventor claims "one and a principal object . . . resides in the provision of a hull form capable of operation at extremely high speeds." He defines a length beam ratio of 6 to 7.5, a characteristic speed length ratio of between 2.5 and 7.3, a displacement length ratio of between 47 and 51 and defines a speed horsepower formula for high speed hulls having a length of 30 to 45 ft. as:

$$\frac{\text{Weight in lbs.}}{\text{Shaft H.P.}} = \frac{C}{V^2}$$

where C=27,150 if V=knots per hour.

Scaled up to the largest size defined by Burgess ("about 250 feet in length"), the leading characteristics of his hull would be: Beam of 33 to 42 feet; design speed of 39 to 115 knots; displacement of 734 to 797 tons. Burgess teaches the power required for the minimum speed of 39 knots would be in the region of 90,000 Shaft H.P. at the minimum displacement of 734 tons, for a specific power of about 3.

Hull designs using the concept of hydrodynamic lift are known with regard to smaller ships, e.g. below 200 feet or 600 tons powered by conventional propeller drives as shown in U.S. Pat. No. 2,242,707. The shape of this hull is such that high pressure is induced under the hull in an area having a specific shape to provide hydrodynamic lift.

The monohull fast ship (MFS) develops hydrodynamic lift above a certain threshold speed as a result of the presence of high pressure under the aft part of the hull and also in the upper surfaces of the inlet pipes for the waterjets shown in FIG. 16. Such a hull reduces the residuary resistance of the hull in water as shown in FIGS. 11 and 14 described below. Therefore, power and fuel requirements are decreased. Since hydrodynamic lift increases as the square of the velocity, a lifting hull allows higher speeds to be achieved than a traditional hull which tends to "squat" or sink at speeds above a Froude number of 0.42 or a speed length ratio of 1.4. Working boats utilizing the MFS form are now being used at sea or in many of the world's harbor approaches. This hull form has also up to now been considered limited to certain size fast pilot boats, police launches, rescue launches and fast lifeboats, custom launches, patrol boats, and even motor yachts and fast fishing boats which range in size from 16 to 200 feet (from 2 to about 600 tons). For their size, these boats are much heavier and sturdier than the planing boats. In the speed range of 5 to 25 knots, they have a much smoother ride. They also use much less power for their size at speed length ratios lower than 3.0 than does the planing hull, and they are very maneuverable. Although it has generally been claimed by leading naval architects that the practical use of this type of hull is limited to quite small craft, such a hull has been used for a 600 ton yacht. However, it has never been contemplated for commercial or military ships of over 2,000 tons.

U.S. Pat. Nos. 2,342,707 (Troyer) and 4,079,688 (Diry) teach different interpretations of fast displacement hulls which, however, differ from the present invention in both hull-form and operational aspects.

Troyer teaches a "double-ended" boat with a lifting stern in order to combine the alleged superior seakeeping qualities of the pointed or "canoe" stern with the lifting qualities necessary to prevent such a boat from "squatting" at more than "a moderate speed", although such speed is not defined in any respect.

Whatever the capability of the Troyer hull to generate hydrodynamic lift at the stern, such a stern is specifically unsuitable for ships of greater than 600 tons displacement and an operational speed such as 40–50 knots for the present invention due to the fact that a wide transom stern (which Troyer specifically excludes in his teaching) is a fundamental requirement for the efficient installation of waterjets as taught by the present invention as discussed hereinafter. Furthermore, at the speeds for which the present invention is intended (viz: a speed length ratio of 1.4 to 3.0) a greater area of lift is required than is obtainable from the Troyer boat without recourse to excessive beam and associated increase in drag.

Since Troyer teaches no information concerning size, proportions, displacement, speed or power, or their interrelationship, the size or type of craft or purpose of his craft cannot be determined. However, he does teach a "specific form of stern design" for a "boat" with "pointed bow and stern portions".

The Troyer stern has, characteristically, a rounded or pointed plan-form, a chine or sharp angle at the conjunction of the bottom portion and sides below the waterline; and angles of deadrise at the stern which are greater than 10°. In these important features it diverges from the design features set out for the present invention as discussed below.

U.S. Pat. No. 4,079,688 (Diry) also teaches a "displacement-type hull" intended to overcome "the rapid increase in wave generating drag attendant with increased speed", placing the relevant speed to his teaching as a Froude Number of between 0.6 and 1.20. He also teaches a multihull vessel. The major feature of Diry's teaching is: "a high speed displacement hull in which a substantial portion of length comprises a parallel midbody of constant and full section."

Waterjet propulsion systems which substantially reduce the cavitation and vibration problem of propeller drives are known as shown in U.S. Pat. Nos. 2,570,595; 3,342,032; 3,776,168; 3,911,846; 3,995,575; 4,004,542; 4,276,035; 4,611,999; 4,631,032; 4,713,027; and 4,718,870. To date they have not been perceived as useful for propelling larger ships, particularly at high speeds, and are deemed generally too inefficient because they require high pressure at the water inlet in the aft part of the submerged hull, rather than low pressure which generally exists at that portion of traditional large displacement hulls.

U.S. Pat. No. 4,276,035 (Kobayashi) is typical of these patents being applied to small boats. Kobayashi teaches an arrangement for the waterjets having two inlet pipes disposed in tandem, or one behind the other, along the aft part of the centerline of the boat. He specifically states that this is to obviate the possibility that waterjet inlets, placed alongside each other on either side of the centerline, might ventilate, or "rise out of the water" when the boat heels at an angle whilst turning.

The alteration of a ship's trim is the subject of U.S. Pat. No. 4,843,993 (P. Martin). However, Martin teaches the use of this for the purpose of optimizing single screw ship performance in varying depths of water.

There is an increasing need for surface ships that can transit oceans with greater speed, i.e. in the range of forty to fifty knots, and with high stability because of the commercial requirements for rapid and safe ocean transits of perishable cargoes, high cost capital goods, military strategic sealift cargoes, cargoes whose dimensions and density cannot be accepted for air freight, and other time-sensitive freight, particularly in light of the increasing worldwide acceptance of "just-in-time" inventory and stocking practices.

Today's container ships are tending towards greater size, for reduced cargo ton-mile costs, carrying up to 25,000 tons of containerized cargo at a time. This necessitates their visiting a number of ports on both sides of an ocean crossing to load and unload cargo. This is time-consuming and means that the largest ships can only undertake a relatively small number of ocean crossings per year, thus limiting the available financial turnover on their considerable investment cost.

A much faster—but smaller—ship, operating at between 40 and 50 knots, can undertake a transatlantic roundtrip each week between only one port on each side of the ocean crossing. Although carrying only up to 10,000 tons of cargo, this smaller, faster ship could transport about 60% more cargo per year than the larger ship, with each container being subject to a much more controlled collection and delivery system using more disciplined intermodal techniques because at each port the ship is fully unloaded and reloaded. Thus the time taken from pick-up to delivery of each container (door-to-door) could be significantly reduced. For this service a cost premium may be charged, such as is presently charged for airfreight, lying somewhere between the current sea and airfreight tariffs. This premium, together with the much greater cargo turnover on each ship, more than compensates for the increased fuel consumption required for operating at over twice the speed of most current larger container ships.

For the reasons already given, it is impracticable to achieve such an increase in speed by the traditional method of making such container ships very large because, as their length is increased to raise their threshold speed according to Froude's laws, their cargo payload and stability are eroded. Serious questions also arise over the ability of propellers to deliver the necessary power due to their performance being degraded by the onset of cavitation, their impractical size and the problems of optimizing blade pitch at intermediate speeds, which could necessitate very complex gearboxes.

DISCLOSURE OF INVENTION

It is the intention of the present invention to overcome the aforementioned problems of the prior art by providing a monohull fast ship (MFS) having the following characteristics:

1. Wherein the prohibitive drag rise which occurs at the "threshold speed" according to Froude's laws, is reduced by the hull lifting significantly—rather than "squatting", or sinking—at that speed.

2. Wherein the propulsion system's efficiency is not degraded by such high speeds, for which reason waterjets are proposed.

3. Wherein the high pressure excited beneath the hull, at and above the threshold speed, not only lifts the hull but is also synergistic with the requirements for optimum waterjet inlet efficiency.

4. Wherein the flow of water through the waterjet inlet ducts is beneficial to the resistance of the ship at operational speeds such as 40 to 50 knots, due to the added lift generated by the hydrodynamic forces acting within those ducts.

5. Wherein the characteristics of the hull shape contribute to seakeeping qualities as well as the reduced resistance of the hull at high speed.

6. Wherein sufficient power can be delivered using existing marine gas-turbine machinery coupled with waterjet propulsors based on those which, increasingly, are proving efficient and practicable in smaller high speed craft today.

7. Wherein the weight and cost of the structure, powerplants, propulsors, gearboxes, fuel and outfit are not so high as to prohibit the operation of a commercially viable transoceanic service carrying a combination of containerized and/or Roll-on/Roll-off cargo.

As shown in FIG. 13, the MFS generic design of the present invention is operating in the most difficult speed regime, in which hull-form is important in achieving the foregoing characteristics of the present invention. The speed is insufficient to enable the ship fully to aquaplane, or "fly". Yet, conversely, the speed is too high to allow proven design techniques for traditional displacement hulls to be employed. Such techniques, necessary to reduce frictional resistance and delay the onset of prohibitive residuary or "wavemaking" resistance, are in fact quite contrary to the requirements of both hull and waterjet efficiency within and beyond the defined "threshold" speed. This particularly applies in a ship with the low length beam ratio, wide transom and high displacement ratio of the present invention. In this intermediate speed regime such as between 40 to 50 knots features of the hull-form are significant to the technological and commercial viability of the invention.

The present invention overcomes the problems and limitations encountered in prior art hull designs and propulsion systems for fast commercial ships in excess of 2000 tons and pleasure craft in excess of 600 tons.

The present invention provides of a fast yet large commercial ship such as a cargo ship or vehicle ferry prohibitive power attains a greater turnover on investment to offset the higher capital and operating costs.

The present invention achieves a seaworthiness in open ocean conditions superior to that of current commercial ship and pleasure craft designs.

The present invention provides a greater frequency of service per ship and less need to visit several ports on each side of an ocean crossing to increase the cargo loaded onto a ship of sufficient length and size necessary to achieve the high speed required to reduce crossing time significantly.

The present invention attains a wider operating speed envelope which allows more flexible scheduling and greater on-time dependability.

The present invention provides a commercial ship with smaller or shallow harbor access and greater maneuverability than the prior art of similar tonnage, thanks to having waterjets and a built-in trimming or fuel transfer system rather than conventional underwater appendages such as rudders or propellers.

The present invention may be configured in a commercial ship having a waterline length (L) of about 680 feet, an overall beam (B) of about 115 feet, and a full load displacement of about 25,000 to 30,000 tons. However, it is generally applicable to pleasure craft in excess of 600 tons and 200 feet and commercial ships in excess of 2000 tons.

For purposes of steering, a system employing wing waterjets may be used. Furthermore, the wing waterjets can incorporate a reversing system. As a result, a ship utilizing my inventive concept will be maneuverable at standstill.

The present invention utilizes a known MFS design with inherent hydrodynamic lift and low length-to-beam (L/B) ratio but in a heretofore unknown combination with gas turbine power and waterjet propulsion which requires, for best efficiency, high pressure at the inlet of the waterjets which corresponds to the stern area of the MFS where high pressure is generated to lift the hull.

An advantage of a waterjet propulsion system in the MFS hull is its ability to deliver large amounts of power at high propulsive efficiency at speeds of over 30 knots and yet decelerate the ship to a stop very quickly. The system also largely eliminates the major problems of propeller vibration, noise and cavitation. A principal advantage of the integrated MFS and waterjet system is that the shape and lift characteristics of the hull are ideal for the intakes and propulsive efficiency of the waterjet system, while the accelerated flow at the intakes also produces higher pressure and greater lift to reduce drag on the hull even further.

Since it is advantageous for waterjet propulsion systems to have an area of higher pressure in the vicinity of the water inlet and since a wider flat transom area is required to install the jet units, the MFS hull is ideally suited for waterjet propulsion. A highly efficient propulsion system, combined with gas turbine main engines, can be provided to meet the higher power levels required for large, high speed ships.

The low length-to-beam ratio of the present invention provides for greater usable cargo weight and space and improved stability.

The waterjet propulsion system provides greater maneuverability than with propellers due to the directional thrust of the wing waterjets and the application of high maneuvering power without forward speed.

The waterjet propulsion units or pumps driven by marine gas turbine units of the present invention produce an axial or mixed flow of substantial power without the size, cavitation and vibration problems inherent in propeller drives.

Reduced radiated noise and wake signatures are produced by the invention due to the novel hull design and waterjet propulsion system.

The MFS hull may be economically produced in available commercial shipyards.

Marine gas turbine engines which are used by the present invention presently produce, or are being developed, to produce greater power for a lower proportional weight, volume, cost and specific fuel consumption than has been available with diesel or steam powered propeller drives.

The MFS hull underwater shape avoids the traditional drag rise in merchant ships. Due to the MFS hull shape of the present invention, the stern of the ship begins to lift (thereby reducing trim) at a speed where the stern of a conventional hull begins to squat or sink.

The present invention combines the power and weight efficiencies of marine gas turbines, the propulsive efficiency of waterjets, and the hydrodynamic efficiency of a MFS hull shaped to lift at speeds where traditional hulls squat. The present invention finds particular utility for maritime industry vessels in excess of approximately 200 feet overall length, approximately 28 feet beam and 15 feet draft and approximately 600 tons displacement.

A merchant ship, according to the present invention would utilize eight conventional marine gas turbines of the type currently manufactured by General Electric under the designation LM 5000 or LM 6000 and four waterjets of the general type currently manufactured by Riva Calzoni or KaMeWa. The waterjet propulsion system has pump impellers mounted at the transom and water ducted to the impellers from under the stern through inlets in the hull bottom just forward of the transom. The inlets are disposed in an area of high pressure to increase the propulsive efficiency of the waterjet system.

The acceleration of flow created by the pumps within the inlet pipes produces additional dynamic lift which also increases the efficiency of the hull. The result is an improvement in overall propulsive efficiency compared to a hull with a conventional propeller propulsion system, with the most improvement in propulsion efficiency beginning at speeds of about 30 knots.

Maneuvering is accomplished with two wing waterjets, each wing jet being fitted with a horizontally pivoting nozzle to provide angled thrust for steering. A deflector plate directs the jet thrust forward to provide stopping and slowing control. Steering and reversing mechanisms are operated by hydraulic cylinders positioned on the jet units behind the transom. Alternatively, conventional rudders can be used.

A ship in accordance with the present invention will be able to transport up to 10,000 tons of cargo at an average speed of 37 to 45 knots across the Atlantic Ocean in about 3 to 4 days in sea states up to 5, with a 10% reserve fuel capacity.

An integrated control system may be provided to control gas turbine fuel flow and power turbine speed, and gas turbine acceleration and deceleration, to monitor and control gas turbine output torque, and to control the waterjet steering angle, the rate of change of that angle, and the waterjet reversing mechanism for optimum stopping performance. Such a system may use as inputs parameters which include ship speed, shaft speed, gas turbine power output (or torque).

The foregoing control system will allow full steering angles at applied gas turbine power corresponding to a ship speed of about 20 knots. It will progressively reduce the applied steering angle automatically at higher power and ship speeds and further allow full reversing of the waterjet thrust deflector at applied gas turbine power corresponding to a ship speed of around 20 knots. Moreover, the control system will automatically limit waterjet reversing deflector movement and rate of movement at higher power and control the gas turbine power and speed to be most effective at high ship speeds.

In summary, the present invention has the following advantages:

1. Lower hull resistance at high ship speeds compared to a conventional merchant ship hull of the same size and proportions.

2. Sufficiently high displacement length ratio to enable commercial cargoes to be carried without recourse to expensive lightweight structures.

3. High inherent stability allowing a large quantity of cargo to be carried above the main deck with adequate reserve of stability.

4. High inherent stability having the effect that there is no requirement for the vessel to be ballasted as fuel is consumed, thus providing increasing top speed at constant power with distance travelled.

5. Low length beam ratios providing large usable internal volume compared with a similar displacement high speed conventional vessel.

6. Large potential reserve of damage stability.

7. Ability to operate at high speed in adverse weather conditions without (a) causing excessive hull strength problems (b) having adverse subjective motion (c) excessive hull slamming and deck wetness.

8. Ability to operate effectively and efficiently on two, three, or four waterjets due to a favorable combination of hull, waterjet and gas turbine characteristics.

9. Ability to accommodate four large waterjets across the ship transom and provide sufficient bottom area for their intakes.

10. Integration of the waterjet/gas turbine propulsion system being optimized by the aft section hull form.

11. Lower technical risk than a conventional hull form of similar displacement for the speed range 40 to 50 knots due to use of waterjets rather than large, complex and less efficient propeller systems.

12. Superior maneuverability at both low and high speeds and ability to stop in a much shorter distance.

13. Ability to utilize a fuel trimming system, as would be incorporated in the design for ensuring optimum longitudinal center of gravity at all speeds and displacements, for other uses such as operating in shallow water or for amphibious purposes.

14. Dispensing with rudders or propellers and associated appendages reducing the possibility of underwater damage in shallow water, maneuvering or in amphibious operations.

To this end it is necessary to describe the major physical and operational characteristics of the present invention. These are:

1. A hull which is optimized for operation at a length Froude Number of greater than 0.4 and up to 0.9.

2. A length-to-beam ratio (the waterline length in feet divided by the maximum waterline width, or beam, in feet, expressed as L/B) of between 5 and 7.5.

3. A displacement length ratio or the displacement in long tons, divided by the cube of one percent of the waterline length in feet, expressed as $$\frac{D}{\left(\frac{L}{100}\right)^3},$$

of between 60 and 150.

4. A specific power (the shaft horsepower divided by the product of the displacement in long tons and the speed in knots, expressed as SHP/DxV) of less than 1.0.

5. The bottom portion of the hull having a longitudinal profile which is non-convex relative to the center of the ship, the contour of which depends on the normal operating speed and displacement of the ship, rising from a point of maximum depth forward of the longitudinal center of the hull to a point of minimum depth at the transverse stern or transom, such minimum depth being less than 60% of the maximum depth.

6. The transom width at the datum waterline being at least 85% of the maximum width of the hull at the datum waterline.

7. The transverse sections of the hull, from about 30% of the ship's length aft of the forward perpendicular (or conjunction of the stem with the datum waterline) to the stern, being rounded at their conjunction with the sides of the hull and being non-concave in section on each side of the keel or centerline, except for those of about the forward 25% of the ship's length, which are concave and meet the sides, of the hull in a "knuckle".

8. A hull in which the sides are non-concave in planform at the datum waterline.

9. The maximum angle of deadrise (the angle between the upward slope of the bottom transverse sections and horizontal) at the transom being less than 10°.

The combination of all the above features in accordance with the present invention satisfies the many conflicting requirements of the particular speed regime for which the hull is intended such as operation between 40 and 50 knots. To combine such speed with the necessary economy of construction, stability, load carrying capacity, seaworthiness and practicability required for effective commercial, military or recreational operation, is the major advantage of this invention over any prior art ship design.

As an indication of the very different characteristics of the MFS ship of the present to the same maximum length of 250' taught by Burgess and discussed above with reference to the prior art would exhibit the following characteristics: Beam of 33 to 50 feet; design speed of 22 to 47 knots; displacement of 938 to 2344 tons. For the minimum design speed of U.S. Pat. No. 2,185,430 the present invention would only require 33,716 Shaft H.P. at a displacement of 938 tons, according to tank tests, giving a specific power of 0.922.

Thus, notwithstanding a 28% greater displacement, the present invention would require less than one-half of the power disclosed for the Burgess hull at the same scaled speed. This only reflects the fact that the Burgess hull is intended to be efficient at a very much higher scale speed than the present invention—a speed which is, however, beyond the capability of modern propulsion systems except for quite small craft.

At the scale of the 679 foot and 25 to 30,000 ton MFS of the present invention, the Burgess hull would only exhibit a maximum displacement of 14,136 tons but still require some 3,000,000 Shaft H.P. for its minimum design speed of 65 knots, assuming the same specific power as in the earlier example.

If such installed power were available, the smaller transom width of the Burgess hull would restrict greatly the amount of power which could be delivered.

By contrast, using currently available gas turbine machinery, with a maximum output of up to 440,000 Shaft H.P., coupled with a waterjet system derived from existing service units, the present invention achieves a speed well within its intended performance regime, whilst carrying the necessary commercial cargo.

In profile, the present invention shows an underbody rising from a point of maximum depth to a point of minimum depth, at the transom, which is only some 20% of the maximum. Burgess teaches an almost level underbody profile—which may be derived from the necessity of maintaining a longitudinal center of buoyancy far aft of amidships, as is necessary at very high speed and as discussed in his text.

With either propeller or waterjet propulsion systems, it is desirable to accommodate all the propelling means within the extreme dimensions of the hull of the ship. This is why a wide transom is an essential feature of the present invention; transom width is a major physical requirement of the present invention in providing the desired speed of operation such as 40 to 50 knots since transom width limits the size and hence power of both waterjets and propellers. Since Burgess teaches a considerably narrower transom relative to his maximum hull width, yet requires considerably more power at speeds within the regime of the present invention, his hull is unsuitable for waterjet propulsion at any size above small craft.

The transverse sections of the Burgess hull differ from those of the present invention, as expected from a hull which is intended for a much higher proportional operating speed or speed length ratio. His sections have a hard chine throughout the underwater section, combined with concave bottom sections on either side of the keel. His waterline in plan-form, at datum, exhibits a concavity, or "wasp-like waist" as he describes it. The deadrise angle at the stern of the Burgess hull is about twice that of the present invention.

In summary, the Burgess hull is, in physical terms as in operational terms, different than from that of the present invention in that his hull is intended to be used for a totally different purpose, at smaller scale, and at much higher proportional speed than the present invention.

Diry's hull is contrary to the hull of the present invention, which features a hull of continually changing section; indeed, no portion of length of the hull is constant in section at any point. Diry also teaches that the entry of the vessel is formed in a particularly unique manner. It is defined by a ramp sloping upwardly from the centerline of the hull bottom toward the waterline at the bow. The slope of this ramp is preferable between 1:16 and 1:12. The ramp extends over at least one-half the length of the entry section.

This feature is at variance with the entry section of the present invention, which is not "ramped" in a constant straight line in profile (as per FIG. 4 of Diry's teaching), but is a convex curve in profile relative to the longitudinal center line of the ship. The bow sections of the present invention are concave relative to the longitudinal center line of the ship and sharply pointed at the keel—rather than convex and flat at the keel, as in Diry's FIG. 5—in the area about 30% of the ship's length aft of the forward perpendicular, which is similar in proportion to Diry's "entry length". Diry's hull and the present invention are divergent in these three important aspects.

Finally, Diry teaches that his hulls are intended to operate in the Froude number range of 0.6 to 1.20. This excludes the very important lower Froude number range of 0.42 to 0.6 for which the present invention is optimized and which, at the MFS scale of 679 feet waterline length, equates to speeds of between 35 and 52 knots, which is about the maximum for which there is likely to be sufficient power available for a hull which is sufficiently affordable, stable and practicable for profitable commercial operation with containerized cargo.

FIG. 11 shows a shaft horsepower comparison between an MFS frigate (curve A with the circle data points) and a traditional frigate hull (curve B with the triangular data points) of the same length/beam ratio and 3400 tons displacement. Between about 15 and approximately 29 knots both ships require similar power. From 38 up to 60 knots the MFS would operate within the area of its greatest efficiency and benefit increasingly from hydrodynamic lift. This speed range would be largely beyond the practicability for a traditional displacement hull unless the length of a displacement hull was increased substantially in order to reduce speed length ratio or the length to beam ratios were substantially increased. Hydrodynamic lift in an MFS design is a gentler process which is more akin to a high speed performance sailing boat than the planing hull which is raised onto the plane largely by brute force. An MFS does not fully plane and thereby avoids the problem of slamming against waves at high speeds.

In addition, modern large ships have traditionally been propeller driven with diesel power. Propellers are, however, inherently limited in size, and they also present cavitation and vibration problems. It is generally recognized that applying state-of-the-art technology, 60,000 horsepower is about the upper limit, per shaft, for conventional fixed pitch propellers. Moreover, diesel engines sized to produce the necessary power for higher speeds would be impractical because of weight, size, cost and fuel consumption considerations.

If the speed categories in relation to waterline length shown in FIG. 13 herein are examined, the MFS provides fast commercial ships. FIG. 13 described hereinbelow shows a continuum of sizes of semi-planing hulls, small to very large. The MFS is similar in hull form to that which is widely used today in small craft because it offers the possibility of using a displacement length ratio approaching that of displacement hulls and maximum speeds approaching that of planing hulls.

The present invention does not employ the arrangement taught by Kobayashi because of the impossibility of achieving a balanced flow into each pipe when two or more inlet pipes are disposed in tandem. Furthermore, the heel angle of a ship of the size of the present invention is very moderate, compared with such a small boat as Kobayashi teaches; and the high water pressure under the stern and at the outboard inlets will further reduce such a possibility of ventilation.

Therefore it is a feature of the present invention that the waterjet inlet pipes are disposed alongside each other, in parallel at the most favorable point in the high pressure area generated under the aft portion of the ship. Due to the inherent wide beam or low length beam ratio, and the wide transom design, there is more space available for implementing this arrangement, thus increasing the proportional limiting maximum power which can be delivered by the waterjets. This is a significant feature of the present invention.

The tandem inlet arrangement taught by Kobayashi is not applicable to the present invention.

BEST MODE FOR CARRYING OUT THE INVENTION

Figure 3:
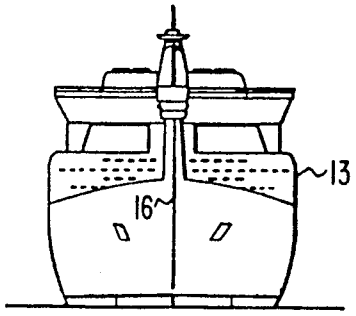
FIG. 3 is a front elevational view viewed from the bow, of the ship shown in FIG. 1.
Figure 1:
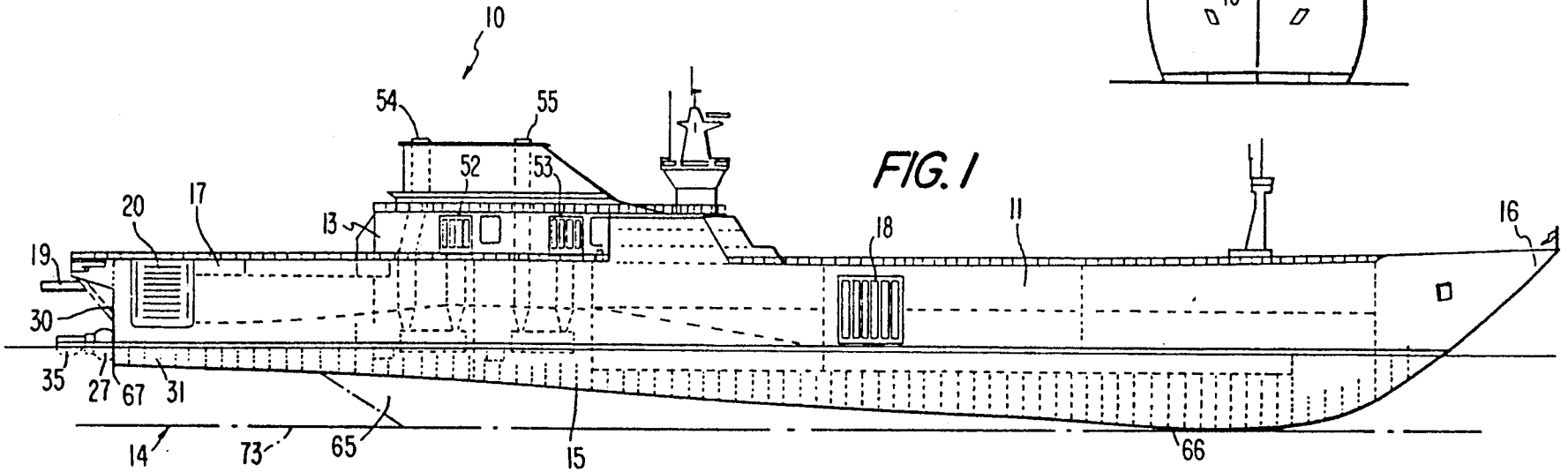
FIG. 1 is a side elevational or profile view of the starboard side of a ship in accordance with the present invention.

Referring now to the drawings in which like reference numerals identify like parts throughout and, in particular to FIG. 1, there is shown a ship, designated generally by the numeral 10, having a semi-displacement or semi-planing round bilge, low length beam ratio (L/B) hull form utilizing hydrodynamic lift at high payloads, e.g. up to 10,000 tons for transatlantic operation at speeds in the range of 40 to 50 knots. The L/B ratio is preferably between about 5.0 and 7.5. The ship has a waterline length over 215 feet and, as illustrated in FIG. 4, a datum waterline length of 679 feet and a displacement length ratio between 60 and 150.

The ship 10 has a hull 11 known as a semi-planing round-bilge type with a weather deck 12. A pilot house superstructure 13 is located aft of amidships to provide a large forward deck for cargo and/or helicopter landing, and contains accommodations, living space and the controls for the ship as well as other equipment as will be hereinafter described. The superstructure 13 is positioned so as not to adversely affect the longitudinal center of gravity. Although a commercial vessel is depicted in the form of a cargo ship in excess of 2000 tons displacement such as but not limited to 20-30 thousand tons, the present invention is also applicable to pleasure craft in excess of 600 tons.

Figure 4:
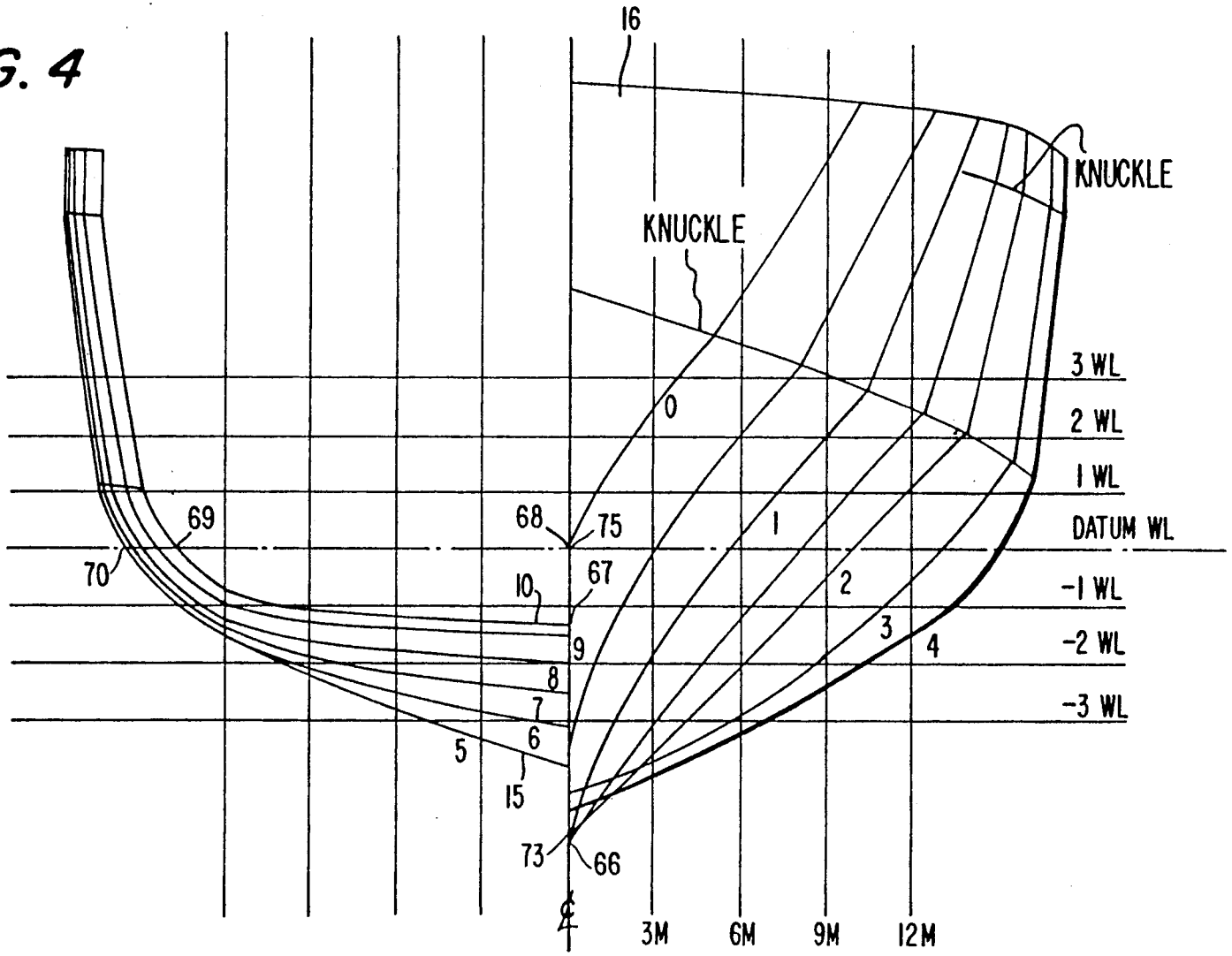
FIG. 4 is a presentation of the sections of the hull showing different contour lines at stations along the length of the hull shown in FIG. 1, half from the bow section and half from the stern section.
Figure 13:
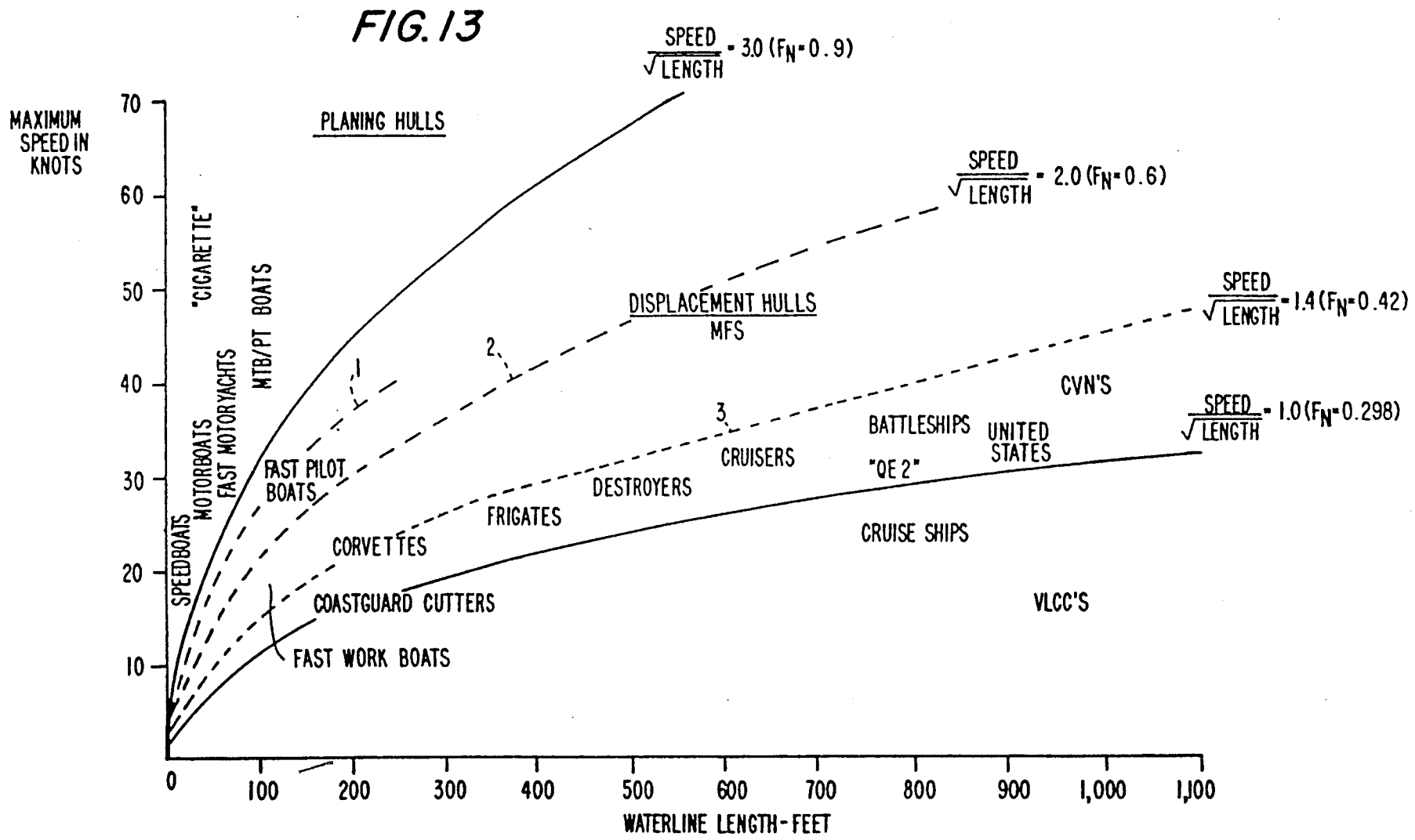
FIG. 13 is a graph of the speed categories of boats, ships and naval vessels in relation to their respective waterline lengths and demonstrating the utility of the MFS hull form in a range of Froude Numbers between above 0.42 and below 0.9 (or $V/\sqrt{L}=1.4$ to 3.0)

The longitudinal profile of the hull 11 is shown in FIG. 1, while the body plan is shown in FIG. 4. A base line 14 shown in dashed lines in FIG. 1 depicts how the bottom 15 of the hull 11 rises from a point of maximum depth towards the stern 17 and flattens out at the transom 30. The bottom 15 of the hull has a non-convex longitudinal profile with respect to the baseline 14 from the point of maximum depth 66 to the point of minimum depth 67. This contour is also illustrated in sectional form in FIG. 4 and runs from a maximum depth (FIG. 4 ref. 66) to a point of minimum depth at the transom (FIG. 4 ref. 67) which is less than 60% of the depth at point 66, in order to provide the necessary high pressure for exceeding the threshold speed without incurring prohibitive transom drag at lower length Froude Numbers. This is a significant feature of the present invention in providing the speed requirement of the present invention which typically operates between Froude Nos. of at least 0.40 and preferably of 0.42 and 0.9 as illustrated in FIG. 13 as compared with the much higher Froude numbers of Burgess or Diry.

Figure 2:
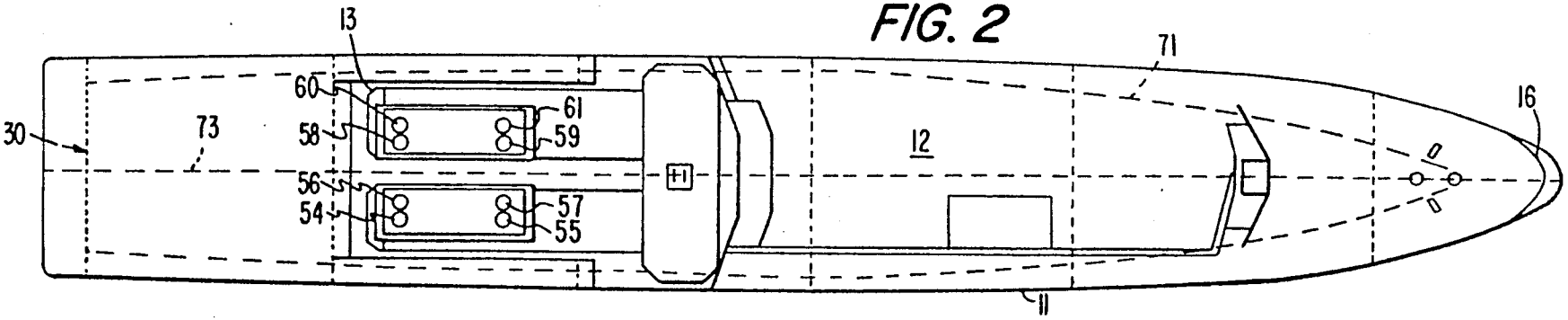
FIG. 2 is a top plan view of the ship shown in FIG. 1.
Figure 14:
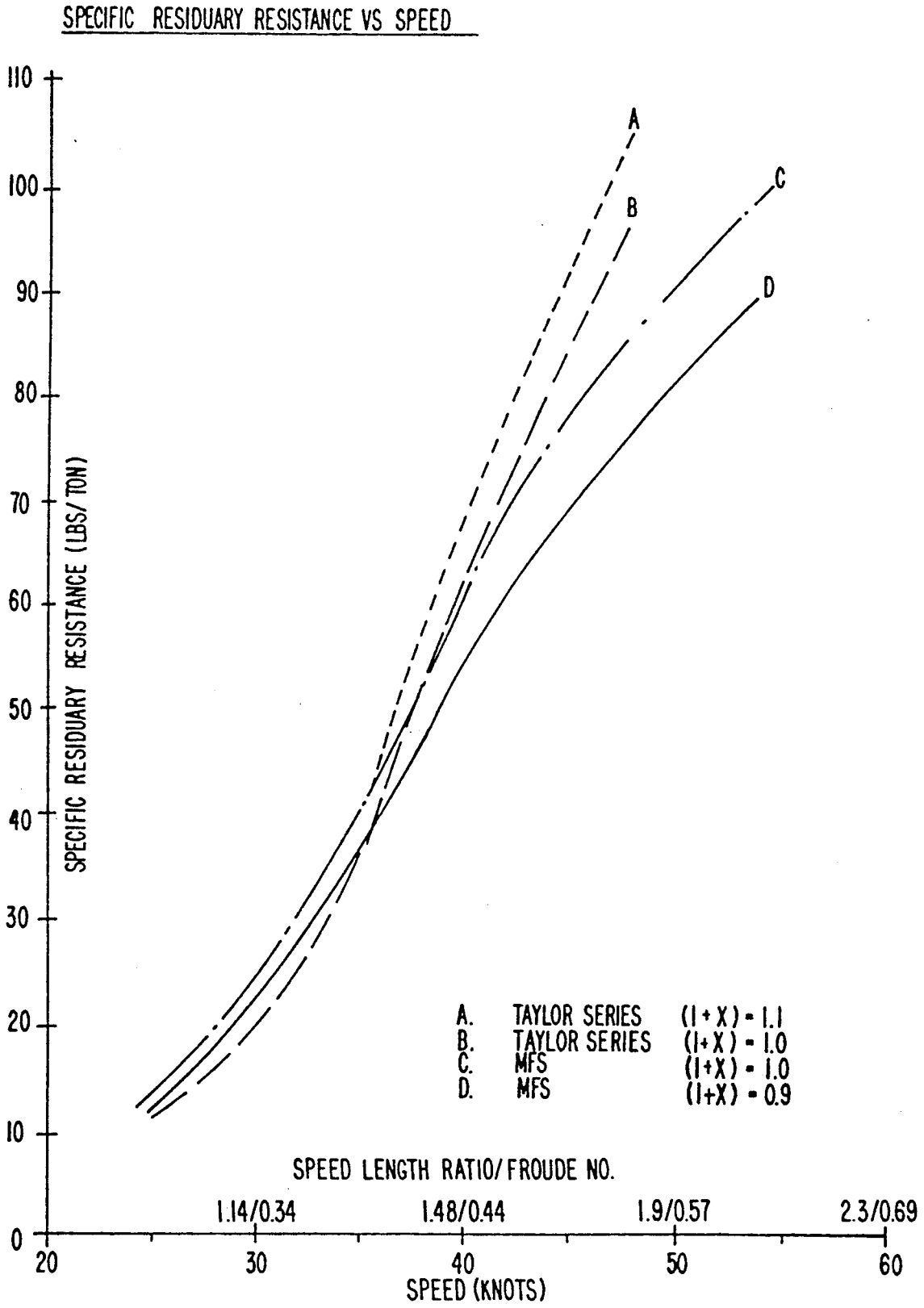
FIG. 14 is a graph of specific residuary resistance in relation to ship speed demonstrating that a 679 foot waterline length MFS of the present invention provides reduced drag at increased absolute speed, speed length ratio and Froude Number, compared with conventional displacement hulls of the Taylor Standard Series of the same length, beam and displacement.

FIG. 4 is a presentation of the sections of the MFS hull form of 679 feet datum waterline length with the right side showing the configuration at the forward section of the ship and the left side showing the configuration at the aft section. The drawing describes the cross-section of the MFS hull in terms of meters from the beam center line and also in tenths of the ship's length from the forward perpendicular 68 to the aft perpendicular 75. The MFS hull has a traditional displacement hull shape with a keel in the forward section and a flattened bottom in the aft section. In smaller vessels, a centerline vertical keel or skeg 65 shown in phantom lines in FIG. 1 and designated by the numeral 65 may be fitted, extending from about the deepest point of the forward bilge to a point about one-quarter to one-third keel or skeg improves directional stability and roll damping in smaller ships. It is this hull configuration which produces at a threshold speed a hydrodynamic lift under the aft section to reduce drag in relation to conventional displacement hulls as demonstrated in FIG. 14. At the transom (station or Contour line 10), the distance between the ship's centerline (68) and its conjunction with the ship's side (69) is at least 85% of the distance between the centerline (68) and the point of maximum beam (70). This is in order to accommodate sufficient space for waterjet inlets, or propellers, to deliver the horsepower necessary for speeds of Froude Numbers=0.42 to 0.9 particularly at much greater ship size and displacement length ratio than is taught by prior art such as Burges and Diry. Station or Contour lines numbered 0-2 in FIG. 4 show the non-convex form of hull shape with associated "knuckle" in the bow section 16 viewed from right to left in FIG. 1, whereas the station or contour lines numbered 3-10 show how the bilge in the stern section 17 becomes progressively convex and flattened as also viewed from right to left in FIG. 1. Although there is presently no agreed method for determining the precise speed of onset of hydrodynamic lift as a result of the size and shape of this hull, it has been suggested that such lift is assisted by the flattening of these sections and its onset takes place at a speed length ratio of 1.0 or Froude Number of 0.298 (or a threshold speed of about 26.06 knots at a displacement of 22,000 tons, in the case of the 679 feet MFS). The waterline of the hull, in plan view (FIG. 2 ref. 71), is at all points non-convex with reference to the vessels centerline 73 in order to reduce slamming in the forward sections whilst retaining maximum waterplane area for operating at higher displacement length ratio than taught by Burgess or other prior art. The acute angle between the contour line 10 (transom) at the point of intersection with a horizontal transverse datum Line is a maximum of 10°. The ship, as illustrated, in FIG. 4, has a maximum operating speed of above 34.5 knots and has a maximum displacement of over 600 tons.

The round-bilge hull thus has a "lifting" transom stern 17 which, as is known, is produced by the hydrodynamic force resulting from the hull form which is generally characterized by straight entrance waterlines, rounded afterbody sections typically rounded at the turn of the bilge and non-convex aft buttock lines terminating sharply at the transom. This type of hull is not a planing hull. It is designed to operate at maximum speeds in the Froude Number range of 0.40 and preferably above about 0.42 and below about 0.9 by creating hydrodynamic lift at the afterbody of the hull by the action of high pressure under the stern but without excessive transom drag at moderate Froude Numbers of above about 0.42 to 0.6 within the "threshold" speed range, as characterizes hulls such as those of Burgess and Diry, which are intended for higher Froude Numbers.

The combination of bow sections which are fine at and below the waterline, with a deep forefoot (or forward keel) and full sections above the bow knuckleline are a major factor in reducing slamming accelerations and spray generation at the bow in high sea states. The high pressure at the, stern also acts to dampen out excessive pitching, thus reducing longitudinal stress on the hull girder.

Figure 5:
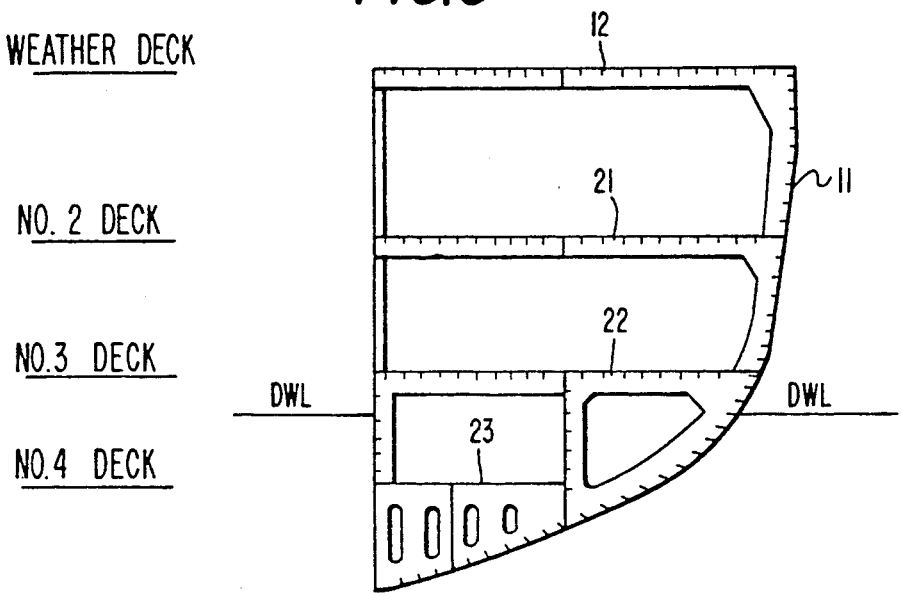
FIG. 5 is a cross-sectional view of the midship section of the hull shown in FIG. 1 to show the arrangement of the decks.

The hull 11 is also provided with an access ramp 18 amidship on the starboard side and a stern roll-on/roll-off ramp 19 so that cargo stored at the three internal decks 21, 22, 23 below the weather deck 12, as illustrated on the midship section shown in FIG. 5, having interconnecting lifts (not shown) can be accessed simultaneously for loading and unloading. Other access ramps can be strategically located such as a ramp 20 provided on the starboard side aft.

Because of the shorter hull design, the hull will achieve required structural strength with greater ease than a long, slender ship for a given displacement. The shape which produces hydrodynamic lift in the MFS hull is well known and its dimensions can be determined by requirements of payload, speed, available power and propulsor configuration. A three-dimensional hull modeling computer program of a commercially available type can generate the basic MFS form with the foregoing requirements as inputs. Once the basic hull parameters are determined, an estimate of the displacement can be made using, for example, two-digit analysis with weight codings from the standard Shipwork Breakdown Structure Reference 0900-Lp-039-9010.

In addition, the shorter hull produces a higher natural frequency which makes the hull stiffer and less prone to failure due to dynamic stress caused by waves, while allowing, in combination with the propulsion system hereinafter described, achievement of speeds in the 40 to 50 knot range.

Waterjet propulsors utilizing existing mixed flow, low pressure, high volume pump technology to produce very high thrust of the order of 200 tons are incorporated in the ship constituting the present invention. The waterjet propulsors are driven by conventional marine gas turbines sized to obtain the high power required. The waterjet propulsor presently contemplated for use is a single stage design which is uncomplicated in construction, and produces both high efficiency and low underwater noise at propulsion power in excess of 100,000 HP.

Figure 15:
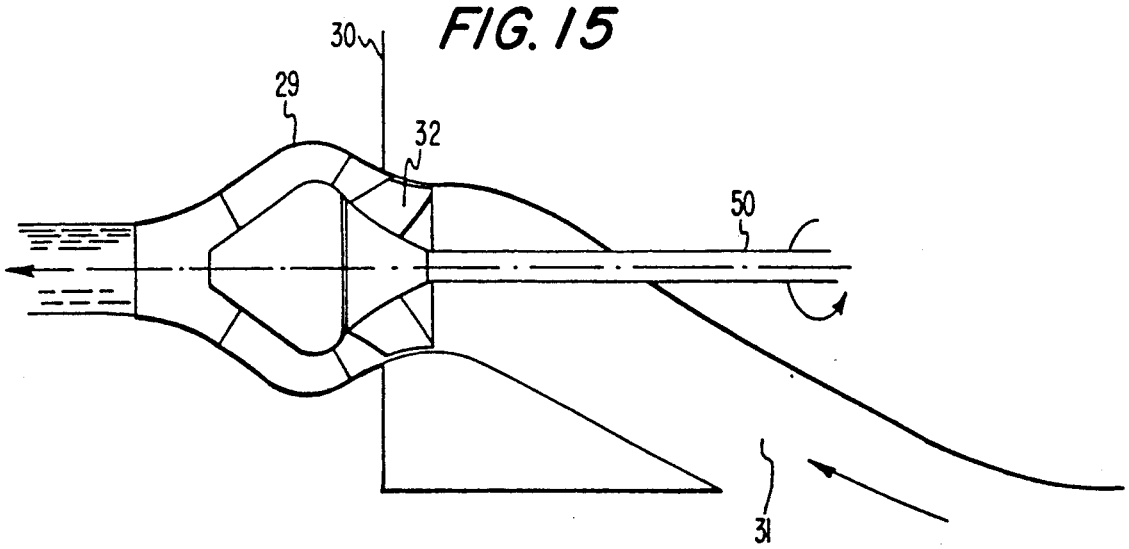
FIG. 15 is a schematic view showing the waterjet propulsion system used in the ship depicted in FIGS. 1-3.
Figure 6:
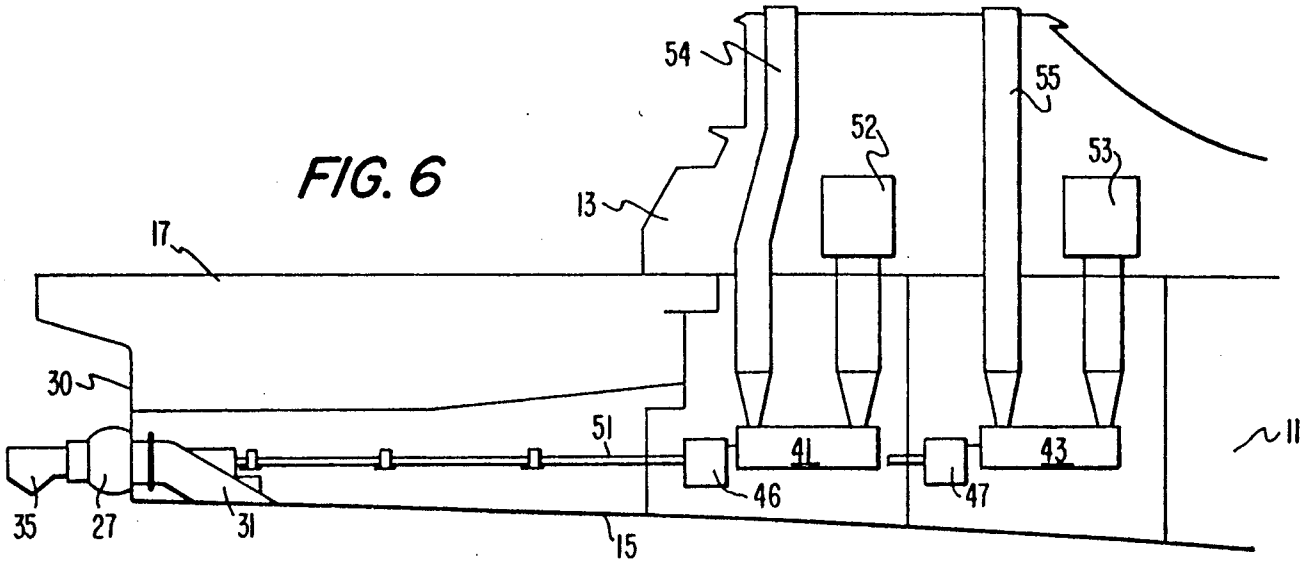
FIGS. 6 and 7 are respectively schematic side elevational and top views showing the arrangement of the water propulsion/gas turbine units within the ship shown in FIG. 1.
Figure 7:
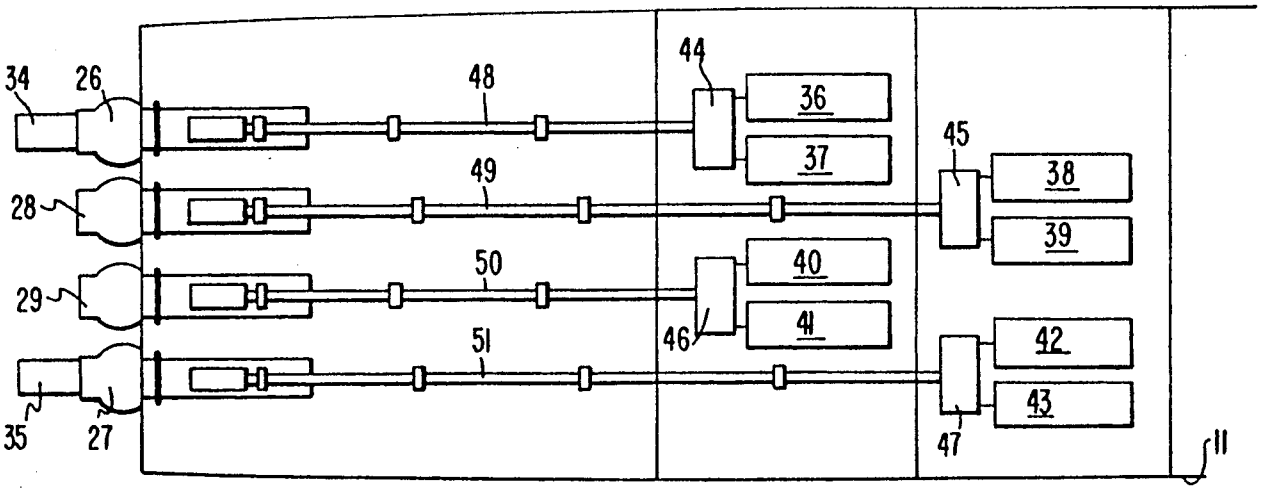

FIGS. 6 and 7 illustrate schematically one embodiment of the waterjet/gas turbine propulsion system. In particular, four waterjet propulsors 26, 27, 28, 29 (one of which is illustrated in FIG. 15) are mounted at the transom 30 with respective inlets 31 arranged in the hull bottom just forward of the transom 30 in an area determined, on an individual hull design basis, of high pressure. Water under high pressure is directed to the impellers of the pumps 32 of the waterjets from the inlets 31. The flow of seawater is accelerated at or around the inlets 31 by the pumps 32 of the four waterjets 26, 27, 28, 29, and this flow acceleration produces additional upward dynamic lift which also increases the hull efficiency by decreasing drag.

The two outermost waterjets 26, 27 are wing waterjets for maneuvering and ahead thrust. Each of the wing waterjets 26, 27 is provided with a horizontally pivoting nozzle 34, 35, respectively, which provides angled thrust for steering. A deflector plate (not shown) directs the jet thrust forward to provide for stopping, slowing control and reversing in a known manner. Steering and reversing mechanisms are operated by hydraulic cylinders (not shown) or the like positioned on the jet units behind the transom. The hydraulic cylinders can be powered by electrical power packs provided elsewhere in the ship. The waterjet propulsion and steering system allows the vessel to be maneuvered at a standstill and also to be decelerated very rapidly.

Marine gas turbines of the type exemplified by General Electric's LM 5000 require no more than two turbines, each rated at 51,440 HP in 80° F. ambient conditions, per shaft line through a conventional combining gearing installation.

Eight paired conventional marine gas turbines 36/37, 38/39, 40/41, 42/43 power the waterjet propulsion units 26, 28, 29, 27, respectively, through combined gear boxes 44, 45, 46, 47 and cardan shafts 48, 49, 50, 51. Four air intakes (only two of which 52, 53 are shown in FIGS. 1 and 6) are provided for the turbines 36 through 43 and rise vertically above the main weather deck and open laterally to starboard and port in the superstructure 13 provided in the aft section. Eight vertical exhaust funnels 54, 55, 56, 57, 58, 59, 60, 61 (FIGS. 2 and 6) for each gas turbine also extend through the pilot house superstructure 13 and discharge upwardly into the atmosphere so as to minimize re-entrainment of exhaust gases. The exhaust funnels can be constructed of stainless steel and have air fed therearound through spaces in the superstructure 13 underneath the wheelhouse.

Figure 8A:
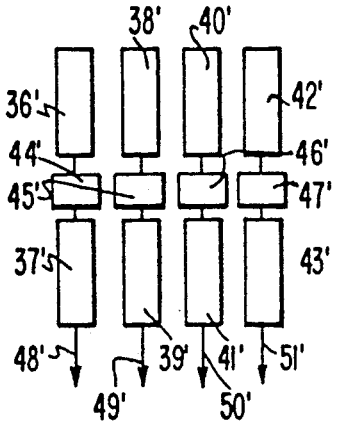
FIGS. 8A through 8D are schematic plan views similar to FIG. 7 showing alternative embodiments of the gas turbines and gear boxes.

The gas turbine arrangement can take several forms to achieve different design criteria. The parts in FIGS. 8A–8D which are similar to those shown in FIG. 7 are designated by the same numerals but are primed. For example, FIG. 8A shows one embodiment where only four pairs of in-line gas turbines to obtain smaller installation width. A gear box is provided intermediate each pair of in-line turbines. This arrangement results in a somewhat greater installation length and a higher combined gear box and thrust bearing weight for each shaft.

Figure 8B:
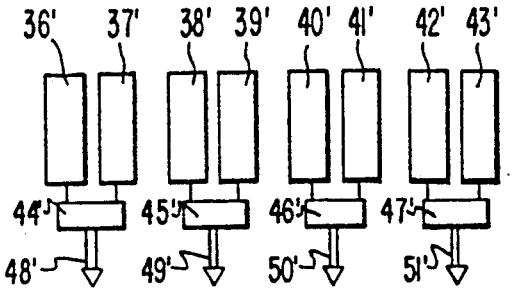
Figure 8C:
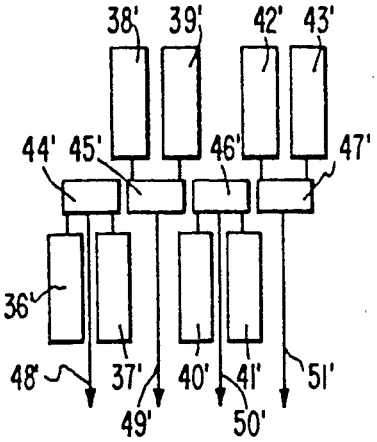
Figure 8D:
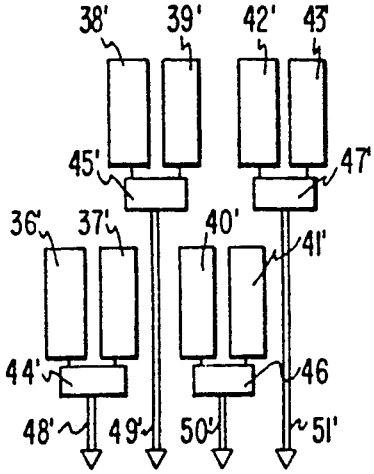

FIG. 8B is an embodiment which reduces the installation length where installation width is not deemed essential. Combined gear box and thrust bearing weight per shaft is also reduced to a minimum and to a like amount as the embodiment of FIG. 8D where installation width is somewhere between the embodiments of FIGS. 8A and 8C. The embodiment of FIG. 8C has the gas turbines in two separate rooms to reduce vulnerability.

Figure 9:
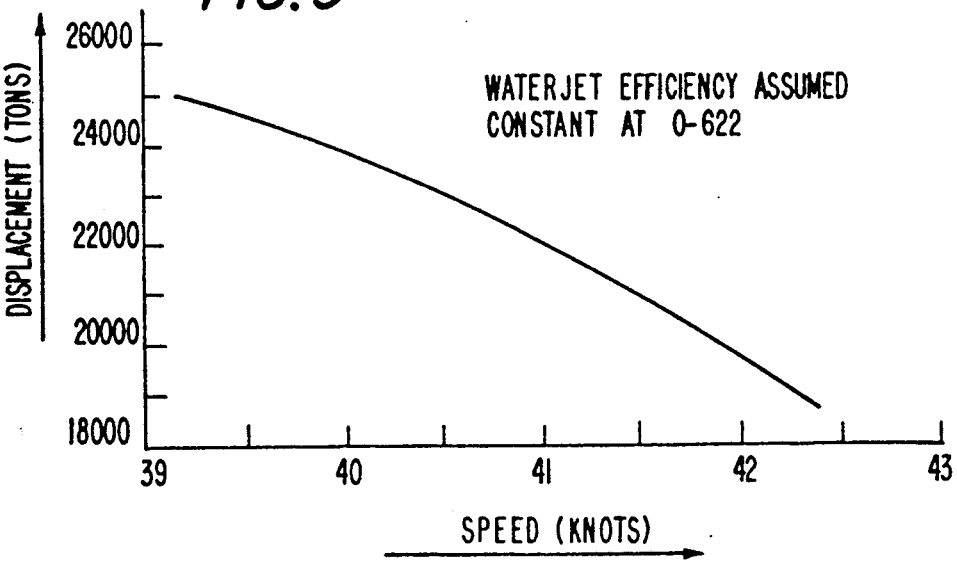
FIG. 9 is a graph showing the relationship between displacement and speed with about 380,000 delivered horsepower (DHP)

FIG. 9 demonstrates the relationship between ship speed in knots and displacement in tons. At constant DHP and waterjet efficiency, speed increases as displacement falls.

Figure 10:
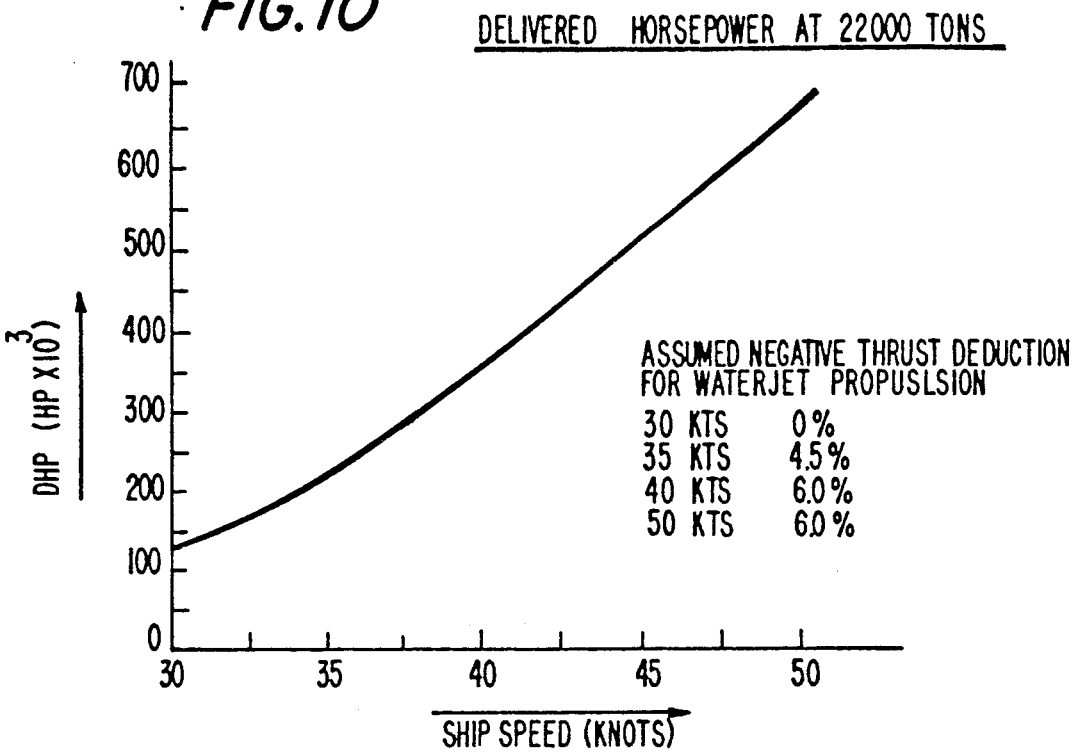
FIG. 10 is a graph showing the relationship between ship speed and delivered horsepower (DHP) for the MFS described hereinbelow.
Figure 11:
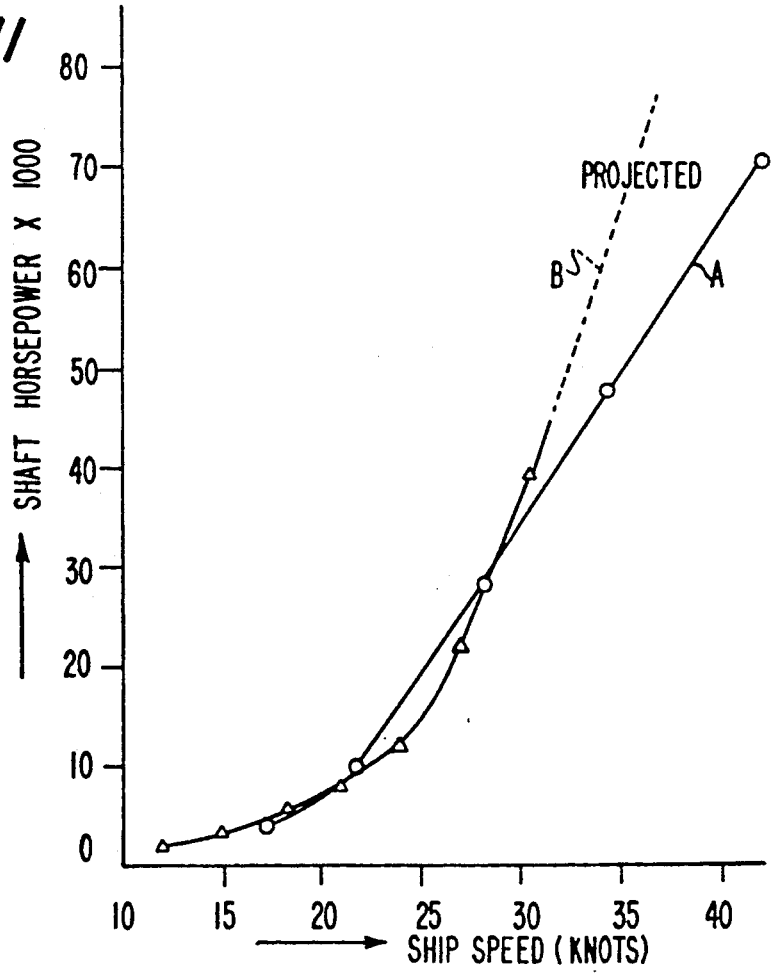
FIG. 11 is a graph showing a comparison of shaft horsepower/speed characteristics between the frigate ship of the present invention and a conventional frigate.

FIG. 10 shows, however, that a linear relationship exists at speeds above 35 knots between delivered horsepower for a vessel of 22,000 tons displacement and ship speed, assuming a certain percentage of negative thrust deductions at certain speeds. For example, to achieve a ship speed of 41 knots, required delivered horsepower will be about 380,000 according to present tank tests.

Figure 12:
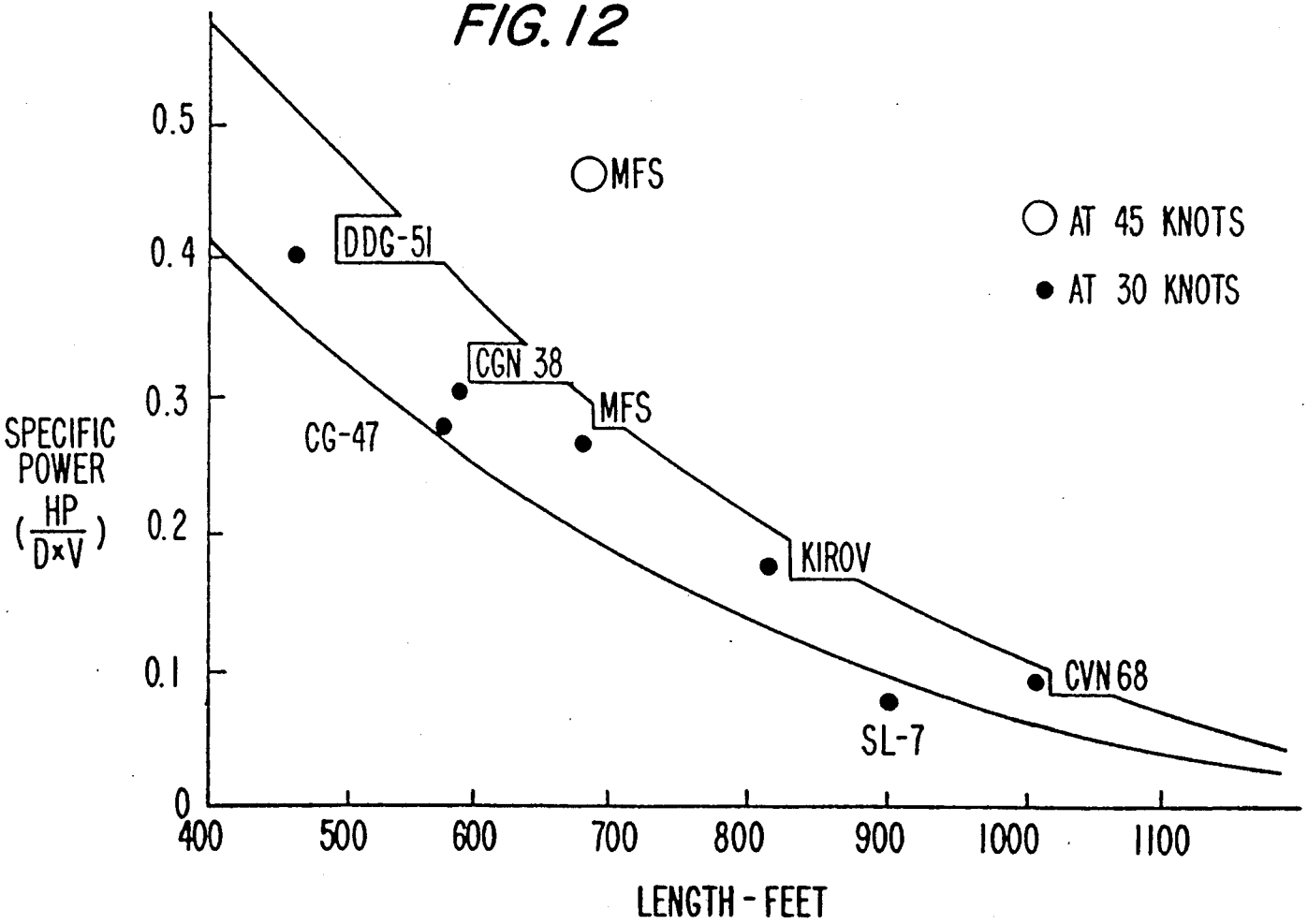
FIG. 12 is a graph comparing the specific power per ton/knot of conventional vessels in terms of their length with that of the present invention.

FIG. 12 shows that at 30 knots, the ship in accordance with the present invention is comparable in performance measured in terms of specific power (where HP=the delivered horsepower, D=displacement in long tons and V=speed in knots) to various other classes of lower speed naval vessels according to length and size. At speeds of 45 knots, however, the present invention provides a vessel in a unique speed class. The prior art of Burgess teaches a specific power of 3.0 at a defined minimum speed of 65 knots at the same scale as the 679 feet MFS of the present invention. This is some seven times the specific power of the present invention at 45 knots, or ten times the specific power of accepted modern naval hulls of the same size at 30 knots. This would be a prohibitive power penalty for such a speed for any presently conceived military or commercial purpose.

FIG. 13 demonstrates the difference between the minimum Froude Number (3) for which the present invention is optimized and the minimum Froude Numbers taught by Burgess (1) and Diry (2). The optimum speed range of the MFS is of a lower Froude Number which poses very different problems such as the relationship of hydrodynamic lift to transom drag, displacement length ratio versus length beam ratio and other questions which are not addressed by the prior art.

Figure 19:
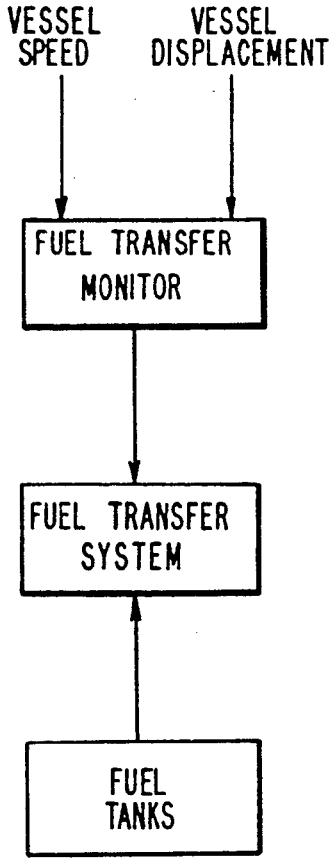
FIG. 19 is a schematic diagram of an embodiment of a fuel transfer system for optimizing trim in the MFS according to the present invention.

The MFS in accordance with my invention also incorporates a fuel system which enables the ship to operate at optimum trim or longitudinal center of gravity (L.C.G.) to obtain minimum hull resistance in terms of absorbed E.H.P. according to speed and displacement. This is achieved either by the arrangement of the fuel tanks in such a way that, as fuel is burned off and speed consequently increased, the LCG progressively moves aft or by a fuel transfer system operated by a monitor with displacement and speed inputs as shown schematically in FIG. 19 in which fuel is pumped forward or aft of midships (station 5 in FIG. 4) by a fuel transfer system of conventional construction to adjust the LCG according to the ship's speed and displacement. This fuel transfer is more readily achieved with gas turbine machinery due to the lighter distillate fuels employed which reduce the need for fuel heating prior to being transferred and is particularly useful in vessels which encounter a variety of speed conditions during normal operation.

Figure 17:
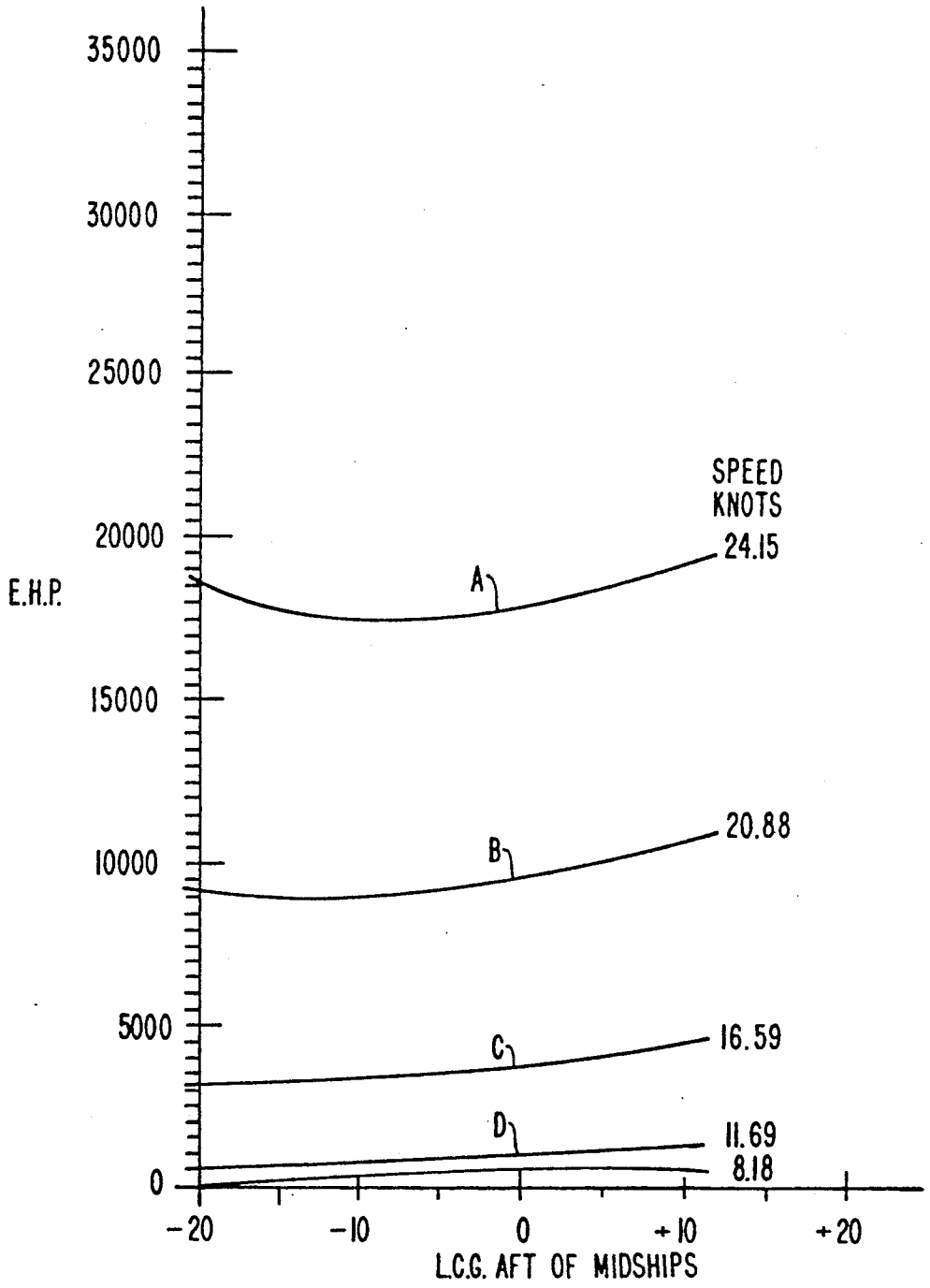
FIG. 17 is a graph based on actual scale model tank tests of a 90 meter, MFS hull of 2870 tons displacement showing how the trim of that hull is optimized by moving the longitudinal center of gravity (L.C.G.) in units of feet forward and aft of midships (station 5 of FIG. 4) designated by the numeral "0" on the abscissa to minimize effective horsepower (E.H.P.) absorbed at different ship speeds.
Figure 18:
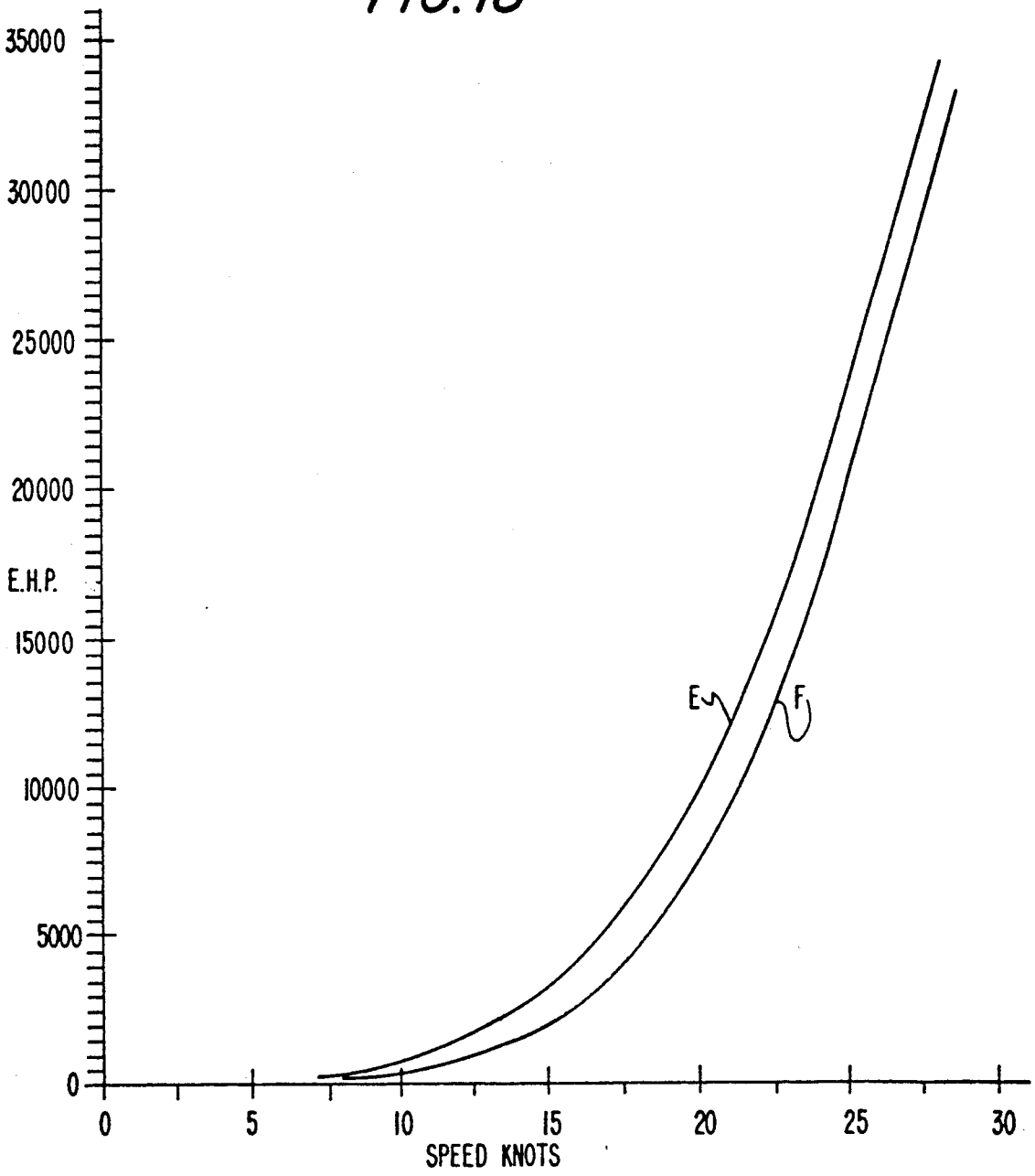
FIG. 18 is a graph based on actual scale model tank tests of the 90 meter, MFS hull of the present invention of 2870 tons displacement referred to above showing the reduction in E.H.P. absorbed where optimized trim is employed.

The advantages of the fuel transfer system, as applied to the MFS described herein are more clearly understood from experimental scale model tank test results on a conventionally propelled smaller MFS hull of 90 meters and 2870 tons as shown in FIGS. 17 and 18.

FIG. 17 demonstrates in general how optimization of trim by moving the longitudinal center of gravity (L.C.G.) forward and aft of midships (station 5 in FIG. 4) in units of feet will reduce the effective horsepower absorbed at certain speeds. The abscissa is scaled in feet and midships is at "0" on the abscissa. Forward of midships is designated by the numerals preceded by a minus sign (e.g. −10 feet) to the left of the zero point and aft of midships by the positive numerals (e.g. 10 feet) to the right of the zero point. Curve A shows that at a speed of 24.15 knots, the optimum trim is obtained by moving the L.C.G. to a point 10 feet forward of midships for minimizing absorbed E.H.P. to a level of 17,250; curve B shows that a speed of 20.88 knots the optimum trim occurs when the LCG is about 13 feet forward so that E.H.P. is at about 8750; curve C shows that at a speed of 16.59 knots the optimum trim occurs when the L.C.G. is about 17 to 18 feet forward; and curves D and E show that at respective speeds of 11.69 knots and 8.18 knots the optimum trim occurs when the L.C.G. is about 20 feet forward of midships. As the displacement of the vessel decreases, e.g. when a substantial amount of fuel has been consumed and speed increases accordingly, optimum trim will occur when the L.C.G. is moved aft of midships to prevent the stern from lifting excessively and thus forcing the bow section down into the water so as to increase resistance.

FIG. 18 illustrates how with a vessel of the foregoing type, which has an L/B ratio of about 5.2, optimum trim can result in considerable E.H.P. savings particularly at lower speeds. The dot dash curve designated by the letter E shows the E.H.P. needed for the vessel having a fixed L.C.G. of 13.62 feet aft of midships, as would be optimum for a speed of 40 knots, over a speed range from about 7.5 knots to about 27.50 knots, and the solid curve designated by the letter F shows the E.H.P. needed when the trim is optimized by moving the L.C.G. forward and aft according to speed and displacement in the manner shown in FIG. 17. It will be seen that, for example, of a speed of 10 knots for this type of vessel, the E.H.P. is reduced by about 50% using optimized trim, and at a speed of 15 knots the power needed is reduced by about 37%. Similar results are achieve with a ship in accordance with the present invention where the L/B ratio is somewhat higher, although the percentage E.H.P. reductions may not be quite as high as the results illustrated in FIG. 18. In this connection, the 12.5 knot speed in FIG. 18 which shows a reduction from 1600 optimized trim will correspond to a 20 knot speed for the SPMH of the present invention, which speed will be a practicable and economic speed for commercial purposes. Likewise, the results shown in FIG. 18 will not be as high as with a ship of the same waterline length and L/B ratio but with lower displacement.

Optimization of trim according to changes in vessel speed and displacement is also useful in ensuring optimum immersion of the waterjet pipes which require the point of maximum diameter of their outlet pipes to be level with the waterline when they are started with the ship at a standstill for proper pump priming. There are also several operational advantages of such a trim optimization system, particularly when using shallow water harbors.

The hull in accordance with the present invention has a length-to-beam ratio of between about 5 to and 7.5 to 1 to achieve a ship design having excellent seakeeping and stability while providing high payload carrying capability. Tank tests suggest that this new vessel design will have a correlation, or (1+x), factor of less than one. A correlation factor is usually in excess of one for conventional hulls (see curves A and B in FIG. 14), normally a value of 1.06 to 1.11 being recommended. This is added to tank resistance results to approximate the actual resistance in a full scale vessel. Thus, a correlation factor of less than one coupled with the hydrodynamic lift is anticipated to result in about a 25% decrease in resistance in the vessel at 45 knots according to my invention as shown by curves C and D in FIG. 14. A ship constructed in accordance with the principles of the present invention will have the following types of characteristics:

PRINCIPAL DIMENSIONS

| | |
|---|---|
| Length Overall | 774' 0" |
| Length Waterline | 679' 0" |
| Beam Molded | 116' 5" |
| Beam Waterline | 101' 8" |
| Depth Amidships | 71' 6" |
| Draft (Full Load) | 32' 3" |
| Length-to-beam ratio | 6.673 |

DISPLACEMENT

| | | |
|---|---|---|
| Overload | 29,526 | long tons |
| Full Load | 24,800 | long tons |
| Half-fuel Condition | 22,000 | long tons |
| Arrival Condition | 19,140 | long tons |
| Light Ship | 13,000 | long tons |
| Displacement Length Ratio | 94.32 | (overload) |
| | 79.2 | (full load) |

SPEED 40 to 50 knots in the half-fuel condition.

ENDURANCE

The endurance is 3500 nautical miles with a 10% reserve margin.

ACCOMMODATIONS

Total of twenty (20) ship handling crew

All accommodations and operational areas are to be air conditioned.

PROPULSION MACHINERY

Eight (8) marine gas turbines, each developing an output power of about 50,000 HP in an air temperature of 80° F.

Four (4) waterjets, two with steering and reversing gear.

Four (4) combining speed reduction gearboxes.

ELECTRIC POWER

Three (3) main diesel-driven a.c. generators and one emergency generator.

Figure 16:
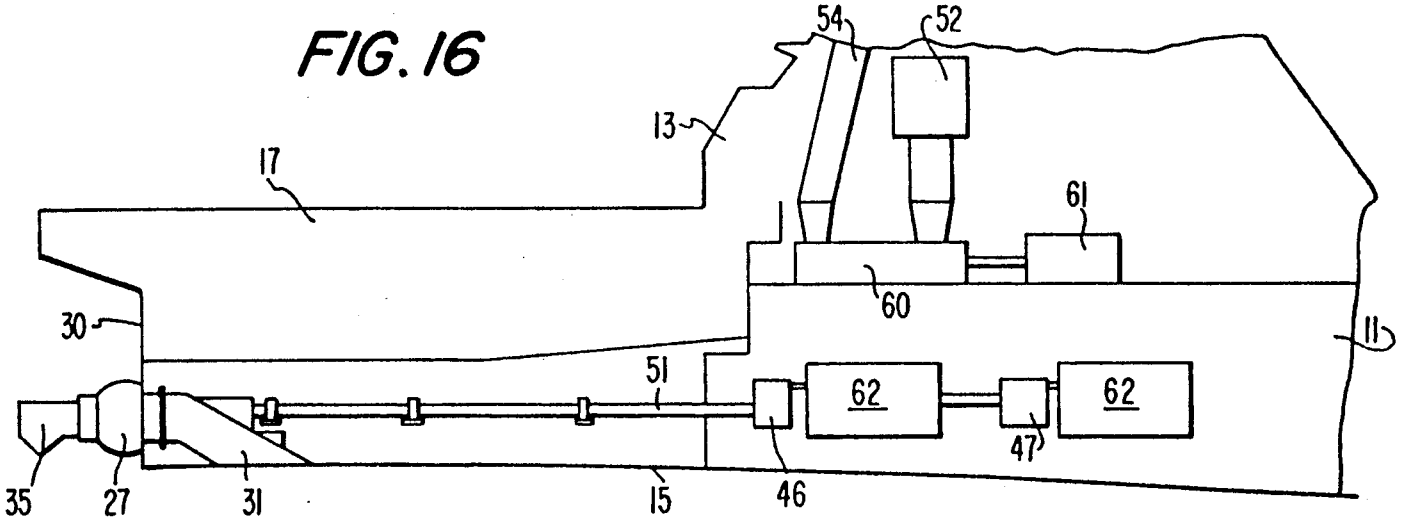
FIG. 16 is a schematic view similar to FIG. 6 but showing a modified gas turbine/electric motor drive for the waterjet propulsion system.

It should be clearly understood that my invention is not limited to the details shown and described above, particularly the characteristics listed in the immediately preceding paragraph, but is susceptible of changes and modifications without departing from the principles of my invention. For instance, FIG. 16 depicts an embodiment where the gas turbines 60 driving one or more generators 61 serve as the primary electrical power source and are carried higher in the vessel than in the FIG. 6 embodiment. The electric power generated by the turbines 60 via the generator or generators 61 is used to turn motors 62 which, with or without gearboxes 46, 47, drive the waterjets 26', 27', 28', 29' which are otherwise identical to the waterjets described with respect to FIGS. 6, 7 and 15. This arrangement allows the gas turbines (60) to be placed in the most convenient position in the ship from the aspect of cargo carrying, LCG or stability or for other reasons. It also reduces the need for gearboxes which can be heavy and expensive; and reduces radiated machinery noise levels. The development of super-conducting technology will also increase the feasibility of this arrangement. Therefore, I do not intend to be limited to the details shown and described herein but intend to cover all such changes and modifications as fall within the scope of the appended claims.

I claim:

1. A ship comprising:

a hull producing a high pressure area at a bottom portion of a stern which rises from a point of maximum depth forward of a longitudinal center of the hull to a point of minimum draft at a transom with the minimum draft being less than 60 percent of the maximum draft;

a width of the stern at a datum waterline being at least 85 percent of a maximum width of the hull at the datum waterline which produces hydrodynamic lifting of the stern at a threshold speed above a length Froude Number of 0.40;

the bottom portion having transverse sections which forward of the stern are convexly rounded with reference to a baseline of the ship at the point of conjunction with sides of the hull and which relative to the baseline of the ship are non-concave in section on each side of a keel except for sections within less than 25 percent of a length of the ship aft from a forward perpendicular which are concave and meet the sides of the ship in a knuckle; and sides of the hull at the datum waterline are non-convex in plan with reference to a centerline of the ship and a maximum angle of dead rise of sections at the stern is a maximum of 10 degrees.

2. A ship in accordance with claim 1 wherein:

a length-to-beam ratio at the datum waterline is between 5 and 7.5 and a displacement-to-length ratio equal to a displacement of the hull divided by a cube of the length divided by 100 during operation of the hull in carrying fuel and payload is between 60 and 150 and a maximum operating Froude Number is between 0.42 and 0.9.

3. A ship in accordance with claim 2 further comprising:

at least one waterjet disposed within the hull and the at least one waterjet having an inlet in a non-concave section of the bottom portion with reference to the baseline which produces the high pressure area during motion of the ship; and wherein a maximum operating Froude Number is not greater than 0.9.

4. A ship in accordance with claim 2 wherein:

the ship has a waterline length over 215 feet.

5. A ship in accordance with claim 4 further comprising:

at least one waterjet disposed within the hull and the at least one waterjet having an inlet in a non-concave section of the bottom portion with reference to the baseline which produces the high pressure area during motion of the ship; and wherein a maximum operating Froude Number is not greater than 0.9.

6. A ship in accordance with claim 4 further comprising:

means for controlling a longitudinal trim of the hull in response to changes in ship speed and displacement.

7. A ship in accordance with claim 6 further comprising:

at least one waterjet disposed within the hull and the at least one waterjet having an inlet in a non-concave section of the bottom portion with reference to the baseline which produces the high pressure area during motion of the ship; and wherein a maximum operating Froude Number is not greater than 0.9.

8. A ship in accordance with claim 6 wherein:

the means for controlling trim comprises fuel tanks disposed within the hull and means for transferring the fuel from within the fuel tanks to move a longitudinal center of gravity aft with respect to the hull.

9. A ship in accordance with claim 8 further comprising:

at least one waterjet disposed within the hull and the at least one waterjet having an inlet in a non-concave section of the bottom portion with reference to the baseline which produces the high pressure area during motion of the ship; and wherein a maximum operating Froude Number is not greater than 0.9.

10. A ship in accordance with claim 6 wherein:

the means for controlling trim comprises fuel tanks disposed within the hull and means for transferring fuel within the fuel tanks to change a longitudinal center of gravity.

11. A ship in accordance with claim 10 further comprising:

at least one waterjet disposed within the hull and the at least on waterjet having an inlet in a non-concave section of the bottom portion with reference to the baseline which produces the high pressure area during motion of the ship; and wherein a maximum operating Froude Number is not greater than 0.9.

12. A ship in accordance with claim 6 further comprising:

at least one waterjet disposed within the hull and an inlet of the at least one waterjet being disposed in the high pressure area of the stern having a maximum angle of deadrise of 10 degrees.

13. A ship in accordance with claim 12 wherein:

a displacement is greater than 600 tons.

14. A ship in accordance with claim 13 further comprising:

the at least one waterjet having an inlet in a non-concave section of the bottom portion with reference to the baseline which produces the high pressure area during motion of the ship; and wherein a maximum operating Froude Number is not greater than 0.9.

15. A ship in accordance with claim 12 further comprising:

the at least one waterjet having an inlet in a non-concave section of the bottom portion with reference to the baseline which produces the high pressure area during motion of the ship; and wherein a maximum operating Froude Number is not greater than 0.9.

16. A ship in accordance with claim 12 further comprising:

a gas turbine coupled to the at least one waterjet for supplying power for driving the at least one waterjet to cause water to be drawn into the inlet of the at least one waterjet and expelled from the at least one waterjet.

17. A ship in accordance with claim 16 further comprising:

the at least one waterjet having an inlet in a non-concave section of the bottom portion with reference to the baseline which produces the high pressure area during motion of the ship; and wherein a maximum operating Froude Number is not greater than 0.9.

18. A ship in accordance with claim 16 wherein:

the at least one waterjet has an impeller which is coupled to said gas turbine by a shaft and gearbox.

19. A ship in accordance with claim 18 wherein:

at least one outboard waterjet is disposed on opposed sides of the transom which provide forward thrust and have means for steering and control of the ship and at least one additional jet providing only forward thrust disposed between the at least one waterjets on opposed sides of the transom.

20. A ship in accordance with claim 19 further comprising:

the at least one waterjet having an inlet in a non-concave section of the bottom portion with reference to the baseline which produces the high pressure area during motion of the ship; and wherein a maximum operating Froude Number is not greater than 0.9.

21. A ship in accordance with claim 18 further comprising:

the at least one waterjet having an inlet in a non-concave section of the bottom portion with reference to the baseline which produces the high pressure area during motion of the ship; and wherein a maximum operating Froude Number is not greater than 0.9.

22. A ship in accordance with claim 12 further comprising:

an electric motor coupled to the at least one waterjet for supplying power for driving the at least one waterjet to cause water to be drawn into the inlet of the at least one waterjet and expelled from the at least one waterjet.

23. A ship in accordance with claim 22 further comprising:

the at least one waterjet having an inlet in a non-concave section of the bottom portion with reference to the baseline which produces the high pressure area during motion of the ship; and wherein a maximum operating Froude Number is not greater than 0.9.

24. A ship in accordance with claim 12 wherein:

the hull has a water line length of between 600 and 700 feet and a maximum operating speed above 34.5 knots with a length Froude Number in excess of 0.42.

25. A ship in accordance with claim 24 further comprising:

the at least one waterjet having an inlet in a non-concave section of the bottom portion with reference to the baseline which produces the high pressure area during motion of the ship; and wherein a maximum operating Froude Number is not greater than 0.9.

26. A ship in accordance with claim 1 further comprising:

at least one waterjet disposed within the hull and the at least one waterjet having an inlet in a non-concave section of the bottom portion with reference to the baseline which produces the high pressure area during motion of the ship; and wherein a maximum operating Froude Number is not greater than 0.9.

27. A ship in accordance with claim 1 wherein:

the hull has a non-convex longitudinal profile with respect to the baseline aft of the point of maximum depth.

* * * * *